US011834803B2

(12) United States Patent
Farrell

(10) Patent No.: US 11,834,803 B2
(45) Date of Patent: Dec. 5, 2023

(54) BOAT DOCKING ASSIST ASSEMBLY

(71) Applicant: Richard Gregory Farrell, Laguna Beach, CA (US)

(72) Inventor: Richard Gregory Farrell, Laguna Beach, CA (US)

( * ) Notice: Subject to any disclaimer, the term of this patent is extended or adjusted under 35 U.S.C. 154(b) by 0 days.

(21) Appl. No.: 18/067,490

(22) Filed: Dec. 16, 2022

(65) Prior Publication Data

US 2023/0220642 A1 Jul. 13, 2023

Related U.S. Application Data

(60) Provisional application No. 63/377,320, filed on Sep. 27, 2022, provisional application No. 63/299,328, filed on Jan. 13, 2022.

(51) Int. Cl.
*E02B 3/26* (2006.01)

(52) U.S. Cl.
CPC ..... *E02B 3/26* (2013.01)

(58) Field of Classification Search
CPC ..... E02B 3/26; E02B 3/24; B63B 59/02
See application file for complete search history.

(56) References Cited

U.S. PATENT DOCUMENTS 3,019,759 A * 2/1962 Woods ..... E02B 3/24 114/230.17
3,139,852 A * 7/1964 Morris ..... E02B 3/24 114/230.18
3,157,150 A * 11/1964 Faber, Jr. ..... E02B 3/24 114/230.18
3,177,839 A * 4/1965 Nolf ..... E02B 3/24 114/230.18
3,861,346 A 1/1975 Pina
5,520,134 A 5/1996 Walker
6,477,968 B2 11/2002 Powell
6,851,380 B1 2/2005 Khoury et al.
7,066,102 B1 6/2006 Tossavainen
9,567,044 B2 * 2/2017 Vandenworm ..... B63B 21/00
(Continued)

FOREIGN PATENT DOCUMENTS

CA 2083010 5/1994
CA 2255429 6/2000
(Continued)

OTHER PUBLICATIONS

FR 2469500 pp. 16 (Year: 1981).*

*Primary Examiner* — Sunil Singh
(74) *Attorney, Agent, or Firm* — Knobbe, Martens, Olson & Bear LLP

(57) ABSTRACT

A docking assist assembly for assisted boat docking. The docking assist assembly may include: a mounting portion configured to be supported by an upper surface of a dock; an arm portion extending transverse to the mounting portion; and a bow retaining portion including a first side defining a first surface facing at least partially toward the second side and a second side defining a second surface at least partially facing toward the first side, said first side and said second side configured to receive a bow of a boat at least partially between the first side and the second side; wherein at least one of the arm portion and the bow retaining portion is movable relative to the mounting portion so as to at least partially absorb a docking impact force of a boat.

13 Claims, 19 Drawing Sheets

(56) References Cited

U.S. PATENT DOCUMENTS

| | | | | |
|---|---|---|---|---|
| 2005/0066869 | A1 | 3/2005 | Alan | |
| 2016/0052609 | A1 | 2/2016 | Mulhern | |
| 2017/0370061 | A1* | 12/2017 | James | E02B 3/20 |
| 2020/0116458 | A1 | 4/2020 | Knezek et al. | |

FOREIGN PATENT DOCUMENTS

| | | |
|---|---|---|
| EP | 3 014 025 | 4/2020 |
| NZ | 549531 | 7/2009 |
| WO | WO 1981/001431 | 5/1981 |
| WO | WO 2009/037440 | 3/2009 |
| WO | WO 2015/143491 | 10/2015 |
| WO | WO 2020/058734 | 3/2020 |

* cited by examiner

BOAT DOCKING ASSIST ASSEMBLY

INCORPORATION BY REFERENCE TO ANY PRIORITY APPLICATIONS

This application claims priority to U.S. Provisional Patent Application No. 63/377,320 filed on Sep. 27, 2022 and titled "BOAT DOCKING ASSIST ASSEMBLY" and U.S. Provisional Application No. 63/299,328 filed on Jan. 13, 2022 and titled "BOAT DOCKING ASSIST ASSEMBLY". The entire contents of the above-referenced applications are hereby expressly incorporated herein by reference in entirety for all purposes.

BACKGROUND

Field

The present disclosure is generally related to the field of boats, boat docks, and methods of parking a boat alongside a dock.

General Discussion

Methods of assisted boat docking currently exist with limitations. A new system would be desirable.

SUMMARY

Various systems, methods, and devices are disclosed for the assisted docking of a boat. The systems, methods, and devices of the disclosure each have several innovative aspects, no single one of which is solely responsible for the desirable attributes disclosed herein.

In one aspect, a docking assist assembly is disclosed. The docking assist assembly may include a mounting portion configured to be supported by an upper surface of a dock; an arm portion extending transverse to the mounting portion; and a bow retaining portion including a first side and a second side, the first side defining a first surface facing at least partially toward the second side and a second side defining a second surface at least partially facing toward the first side, said first side and said second side configured to receive a bow of a boat at least partially between the first side and the second side; wherein at least one of the arm portion and the bow retaining portion is movable relative to the mounting portion so as to at least partially absorb a docking impact force of a boat.

In one aspect, the mounting portion desirably comprises a first side and a second side, the second side defining an interface plane configured to be supported by an upper surface of a dock. In one aspect, the first side and the second side of the bow retaining portion are no longer than 8 feet long. In one aspect, the first side and the second side of the bow retaining portion are no longer than 6 feet long. In one aspect, said first side and said second side of the bow retaining portion are resilient and are movable at least one inch in response to an impact force of 100 pounds. In one aspect, said first side and said second side of the bow retaining portion are movable with respect to one another to facilitate receiving different shape bows there between. In one aspect, neither the arm portion, nor the bow retaining portion projects more than ten feet beyond a side of mounting portion configured to be supported by an upper surface of a dock. In one aspect, the docking assist assembly weighs no more than 500 pounds. In one aspect, the arm portion comprises a first arm portion and a second arm portion, wherein the second arm portion is rotatable relative to the first arm portion and a maximum amount of rotation of the second arm portion from a relaxed position is 45 degrees in a first direction. In one aspect, the second arm portion is rotatable relative to the first arm portion and the maximum amount of rotation of the second arm portion from a relaxed position is 90 degrees in a second direction. In one aspect, the first side of the bow retaining portion and the second side of the bow retaining portion are comprised of a single integral piece. In one aspect, the docking assist assembly further comprising one or more of: lights coupled to the bow retaining portion, a slip resistant platform configured to couple with the upper surface of the dock, and a resilient dock bumper portion configured to couple to a water facing side of the dock.

In one aspect, a docking assist assembly mountable to a dock having a support area and an elongate edge along which a length of a boat is to be docked is disclosed. The docking assist assembly may include, a mounting portion defining a support base; an arm portion configured to extend transverse to the edge of a dock along which a length of a boat is intended to dock, at least a portion of the arm portion movable with respect to the support base; and a bow retaining portion including a first side and a second side, the first side defining a first surface facing at least partially toward the second side and a second side defining a second surface at least partially facing toward the first side, said first side and said second side configured to receive a bow of a boat at least partially between the first side and the second side; wherein movement of the arm portion relative the support base at least partially absorbs a force of a boat docking; wherein when the support base is facing downward both the arm portion and the bow retaining portion either (1) do not extend below the support base or (2) extend less than two feet below the support base; wherein said first side and said second side at least partially include resilient areas configured to cushion the bow of a boat impacting the resilient areas.

In one aspect, a docking assist assembly is disclosed. The docking assist assembly may include a mounting portion configured to be supported by an upper surface of a dock; an arm portion extending transverse to the mounting portion; a bow retaining portion defining an opening for receiving at least a portion of a bow of a boat; wherein at least one of the arm portion and the bow retaining portion is movable relative to the mounting portion so as to at least partially absorb a docking impact force of a boat.

In one aspect, the bow retaining portion is rotatable with respect to the arm portion. In one aspect, the bow retaining portion is resilient and is movable at least one inch in response to an impact force of 100 pounds. In one aspect, the bow retaining portion comprises a first side and a second side, wherein said first side and said second side are movable with respect to one another to facilitate receiving different shape bows there between. In one aspect, the docking assist assembly weighs no more than 500 pounds. In one aspect, the arm portion comprises a first arm portion and a second arm portion, wherein the second arm portion is rotatable relative to the mounting portion and a maximum amount of rotation of the second arm portion from a relaxed position is 45 degrees. In one aspect, the second arm portion is rotatable relative to the first arm portion and the maximum amount of rotation of the second arm portion from a relaxed position is 90 degrees in a second direction. In one aspect, the bow retaining portion is comprised of a single integral piece.

BRIEF DESCRIPTION OF THE DRAWINGS

The foregoing aspects and many of the attendant advantages of this disclosure will become more readily appreciated as the same become better understood by reference to the following detailed description, when taken in conjunction with the accompanying drawings. The accompanying drawings, which are incorporated in, and constitute a part of, this specification, illustrate embodiments of the disclosure.

Throughout the drawings, reference numbers are re-used to indicate correspondence between referenced elements. The drawings are provided to illustrate embodiments of the subject matter described herein and not to limit the scope thereof. Specific embodiments will be described with reference to the following drawings.

DETAILED DESCRIPTION

Figure 1A:
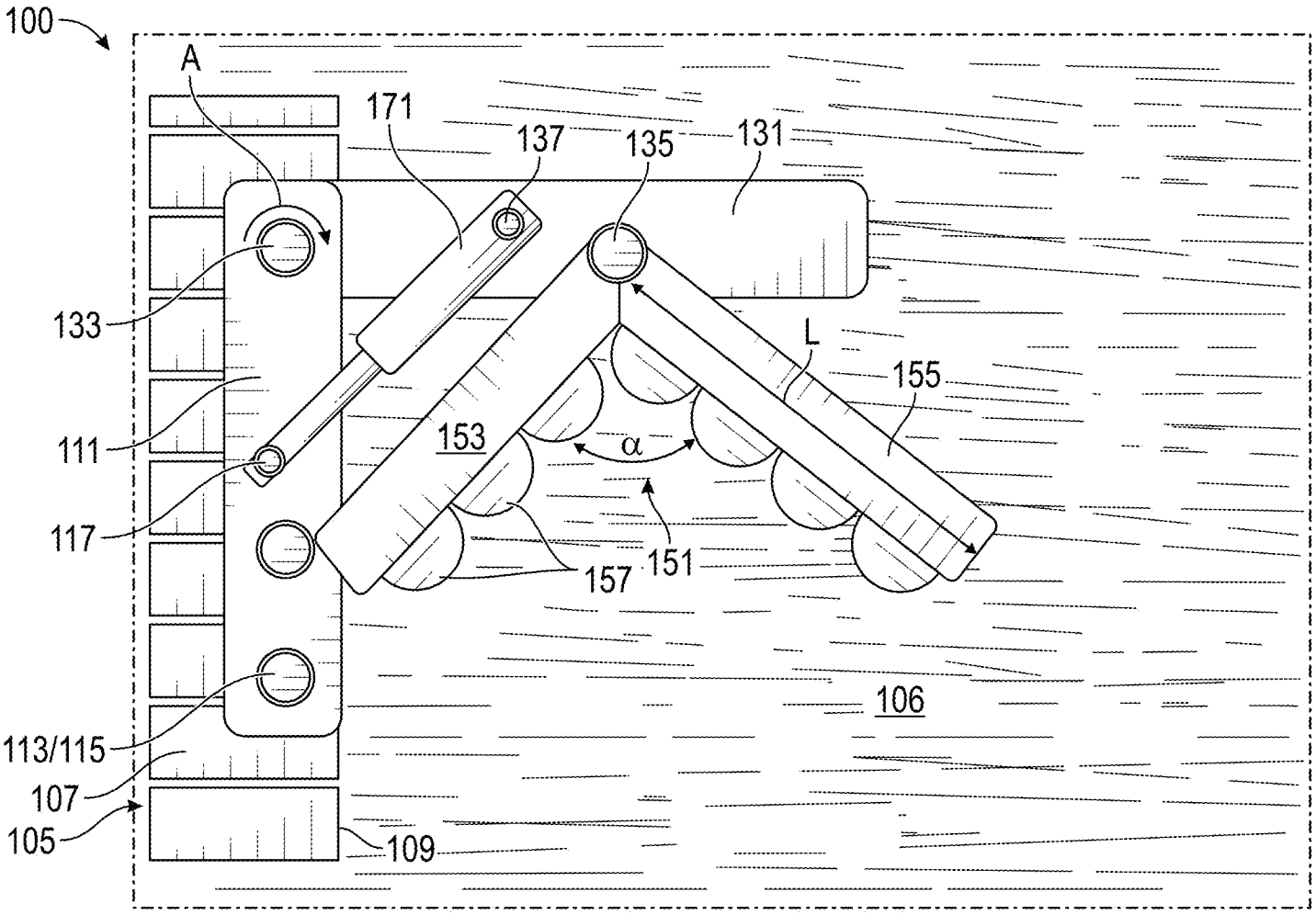
FIG. 1A is a diagram illustrating an embodiment of a L-shaped docking assist assembly.

Embodiments of the disclosure will now be described with reference to the accompanying figures. The terminology used in the description presented herein is not intended to be interpreted in any limited or restrictive manner, simply because it is being utilized in conjunction with a detailed description of embodiments of the disclosure. Furthermore, embodiments of the disclosure may include several novel features, no single one of which is solely responsible for its desirable attributes, or which is essential to practicing the embodiments of the disclosure herein described. For purposes of this disclosure, certain aspects, advantages, and novel features of various embodiments are described herein. It is to be understood that not necessarily all such advantages may be achieved in accordance with any particular embodiment. Thus, for example, those skilled in the art will recognize that one embodiment may be carried out in a manner that achieves one advantage or group of advantages as taught herein without necessarily achieving other advantages as may be taught or suggested herein.

Parking a boat at a dock is a difficult and often dangerous endeavor. A boat operator must approach the dock at the correct angle and speed, as well as maintain the boat's position alongside the dock until the boat can be properly secured. There are also further challenges in rough weather conditions such as high wind speeds. Because of the instability of the boat in the water, there is also a risk of injury to anyone who comes between or puts a limb between the dock and the boat. Parking a boat is made even more difficult when the boat operator is the sole occupant in the boat. To park the boat as the sole occupant, the boat operator must cruise alongside the dock, maintain the position of the boat, and manage to secure the boat to the dock without hitting the dock and causing damage to the boat. This is often difficult to achieve and results in some damage to the boat, dock, or both. Often a person may choose not to go out on the boat as the sole occupant solely because of the difficulty in parking the boat on the return to the dock.

In some embodiments, a docking assist assembly can enable a boat operator to park a boat alongside a dock without causing damage to the boat, the dock, or the boat operator. The docking assist assembly is fixed to a dock and includes an arm portion and bow retaining portion that may be suspended above the water. As a boat operator approaches the docking assist assembly, the operator maneuvers the bow of the boat into the bow retaining portion. The bow retaining portion cushions the impact of the boat on the docking assist assembly and slows and stops the forward motion of the boat without causing damage to the boat. The boat operator can then tie off the stern of the boat and complete the docking process.

It should be noted that the disclosed embodiments of a docking assist assembly may be combined with any embodiments disclosed herein, and individual features of the docking assist assembly may be combined with individual features of any other embodiment. Any other embodiments may also be combined with the disclosed docking assist assembly, and individual features of any embodiment may be combined with individual features of the disclosed docking assist assembly.

Dock, as the term is used herein, is a broad term that can include, but is not limited to, floating dock, fixed dock, float, jetty, landing, levee, pier, quay, wharf, and/or the like. Boat, as the term is used herein, is a broad term that can include, but is not limited to, fishing boat, dinghy boat, deck boat, bowrider boat, cuddy cabin boat, center console boat, houseboat, trawler boat, surf boat, wake boat, speedboat, airboat, inflatable boat, water scooter, and personal watercraft.

Figure 12:
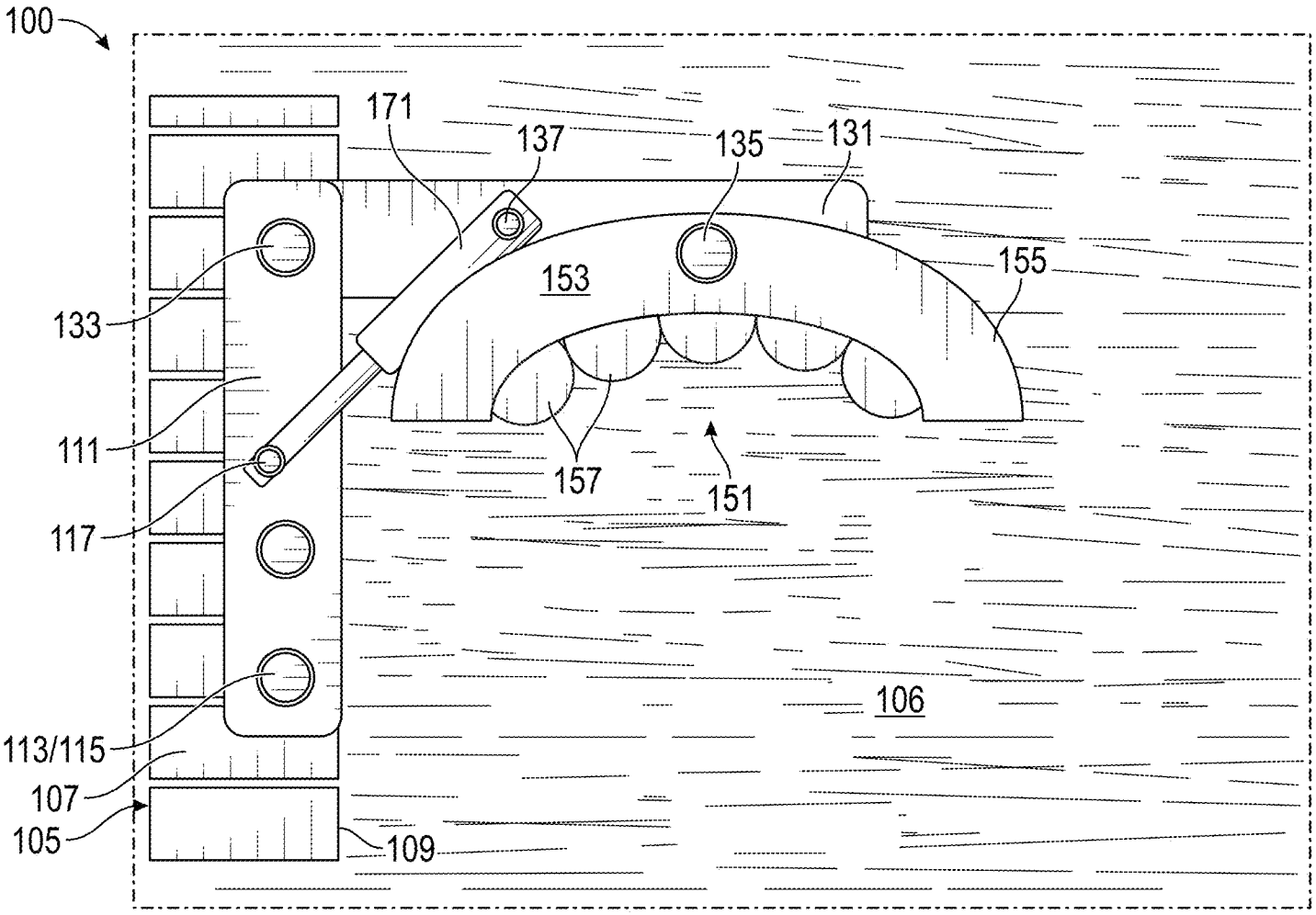
FIG. 12 is a diagram illustrating an embodiment of a docking assist assembly with a single arm bow retaining portion.

FIG. 1A illustrates an embodiment of a docking assist assembly 100 mounted on a dock 105. The docking assist assembly 100 includes a dock mounting portion 111, an arm portion 131, a bow retaining portion 151, and a shock absorption assembly 171. As discussed below, in some embodiments, there is no separate shock absorption assembly, but rather one or a combination of elements of the docking assist assembly permit the bow retaining portion 151 and/or the arm portion 131 to move relative the mounting portion 111. The dock mounting portion 111 may comprise an elongate rectangular plate defining a plane with an upper side 112 and a bottom side 114 (e.g., see FIG. 9), such as a planar surface which is positioned against the upper surface 107 of the dock 105. The dock mounting portion 111 may include mount holes 113 extending through the dock mounting portion 111 and a plurality of dock fasteners 115 extending through the dock mounting portion 111 and into the dock 105 to secure the dock mounting portion 111 in place. The absorber dock mount 117 is located on the dock mounting portion 111 and is used to secure one end of the shock absorption assembly 171 to the dock mounting portion 111. The arm portion 131 may include an arm mount 133 located at one end of the arm portion 131 to attach the arm portion 131 to the dock mounting portion 111, a bow arm portion mount 135 located near the middle of the arm portion 131 to attach the bow retaining portion 151 to the arm portion 131, and an absorber arm mount 137, located on the arm portion 131 to secure one end of the shock absorption assembly 171 to the arm portion 131. It will be appreciated that the bow arm portion mount 135 could be integrally formed with the bow arm portion 131 and/or the bow retaining portion 151. The bow retaining portion 151 may include a first bow arm section 153 and a second bow arm section 155. Either or both of the first bow arm section 153 and the second bow arm section 155 may include a resilient inner portion, such as a bumper portion 157. In one aspect, the first bow arm section 153 and the second bow arm section 155 may comprise a single integral piece, as illustrated in FIG. 12.

In docking assist assembly 100, the dock mounting portion 111 may be fixed to a dock 105 at mount holes 113 by dock fasteners 115 such that one side of the dock mounting portion 111 lies roughly flat on the upper surface of a dock. In the aspect illustrated, the arm portion 131 is mechanically coupled at one end to the dock mounting portion 111 at arm mount 133 such that the arm portion 131 is rotationally moveable relative to the dock mounting portion 111. In one aspect, including the illustrated embodiment, the arm portion 131 may be rotationally movable relative to the dock mounting portion 111 about axis of rotation A. In this position, the arm portion 131 and the dock mounting portion 111 make a L-shape. In one aspect, the arm mount 133 may comprise a pivot assembly, such as shaft and a bearing assembly, to allow the arm portion 131 to rotate about axis of rotation A but limit the movement of the arm portion 131 in a direction extending vertically from the dock 105. The shock absorption assembly 171 is fixed at one end to the dock mounting portion 111 at dock absorber mount 117 and fixed at another opposite end to the arm portion 131 at absorber arm mount 137. In one aspect, absorber dock mount 117 and/or absorber arm mount 137 may be a pivot assembly, such as a shaft and bearing assembly, which may allow the shock absorption assembly 171 to rotate about its fixed points. In another aspect, the dock absorber mount 117 and/or absorber arm mount 137 may comprise a bolt which extends through an opening at one end of the shock absorption assembly 171 and into an opening in the dock mounting portion 111 and through an opening at the opposite end of the shock absorption assembly 171 and into an opening in the arm portion 131, which permits the shock absorption assembly 171 to be secured to the dock mounting portion 111 and/or the arm portion 131. In another aspect, the bolt may extend through the dock mounting portion 111 and into the dock 105. The first bow arm section 153 and the second bow arm section 155 may be fixed at one end to the arm portion 131 at bow portion mount 135. In the aspect illustrated, first bow arm section 153 and second bow arm section 155 are fixed to the same bow portion mount 135. In another aspect, there may be more than one bow portion mounts 135, such that the first bow arm section 153 and the second bow arm portion 155 are fixed adjacent to each other on arm portion 131. In the aspect illustrated, the first bow arm section 153 and the second bow arm section 155 are mechanically coupled at one end to the arm portion 131 at bow portion mount 135 such that the bow retaining portion 151 is rotationally moveable relative to the arm portion 131. In one aspect, including the illustrated embodiment, the bow retaining portion 151 may be rotationally movable relative to the arm portion 131 about axis of rotation B (e.g., see FIG. 1C). In one aspect, the bow portion mount 135 may comprise a pivot assembly, such as a shaft and a bearing assembly, to allow the bow retaining portion 151 to rotate about axis of rotation B but limit the movement of the bow retaining portion 151 in a direction extending vertically from the dock 105. In another aspect, the bow portion mount 135 may comprise a bolt which extends through the bow arm sections 153 and 155 and into the arm portion 131 to secure the bow arm sections 153 and 155 to the arm portion 131. In another aspect, the arm portion 131 may further comprise a bow arm lock, such that rotation of first bow arm section 153 and second bow arm section 155 may be selectively prevented by engaging the bow arm lock. For example, when the bow arm lock is engaged, the first bow arm section 153 and second bow arm section 155 cannot move relative to their point of fixture on the arm portion 131. In another aspect, the first bow arm section 153 and the second bow arm section 155 are fixed with respect to one another. In another aspect, the first bow arm section 153 and the second bow arm section 155 define a V-shape with an angle $\alpha$ between them which faces away from the arm portion 131. Desirably the angle $\alpha$ is between 30 and 120 degrees, between 35 and 105 degrees and/or between 45 and 95 degrees. The bumper portion 157 may desirably be fixed to first bow arm section 153 and second bow arm section 155 on the inward facing side of each bow arm such that in operation, the bumper portion 157 on one arm face the bumper portion 157 on the other arm. In some embodiments, the resilient inner portion, such as a bumper portion 157, may be integrally formed with the bow arm sections 153 and 155. The length "L" of the bow arm sections 153 and 155 is measured from the center-point of the bow portion mount 135 to the tip of a bow arm section as shown on FIG. 1A. In one aspect, the first bow arm section 153 and the second bow arm section 155 are between 2 and 10 feet long, between 3 and 8 feet long or between 3 and 6 feet long. In one aspect, the first bow arm section 153 and the second bow arm section 155 are at least 2 feet long, at least 3 feet long, or at least 5 feet long. In one aspect, the first bow arm section 153 and the second bow arm section 155 are no more than 8 feet long, no more than 6 feet long, no more than 5 feet long or no more than 4 feet long. For purposes of this application, where the first bow arm section 153 and the second bow arm section 155 are a single integral piece, the length of the arm sections shall be considered from the center-point 135 of the contact between the arm portion 131 and the bow retaining portion 151.

Figure 1B:
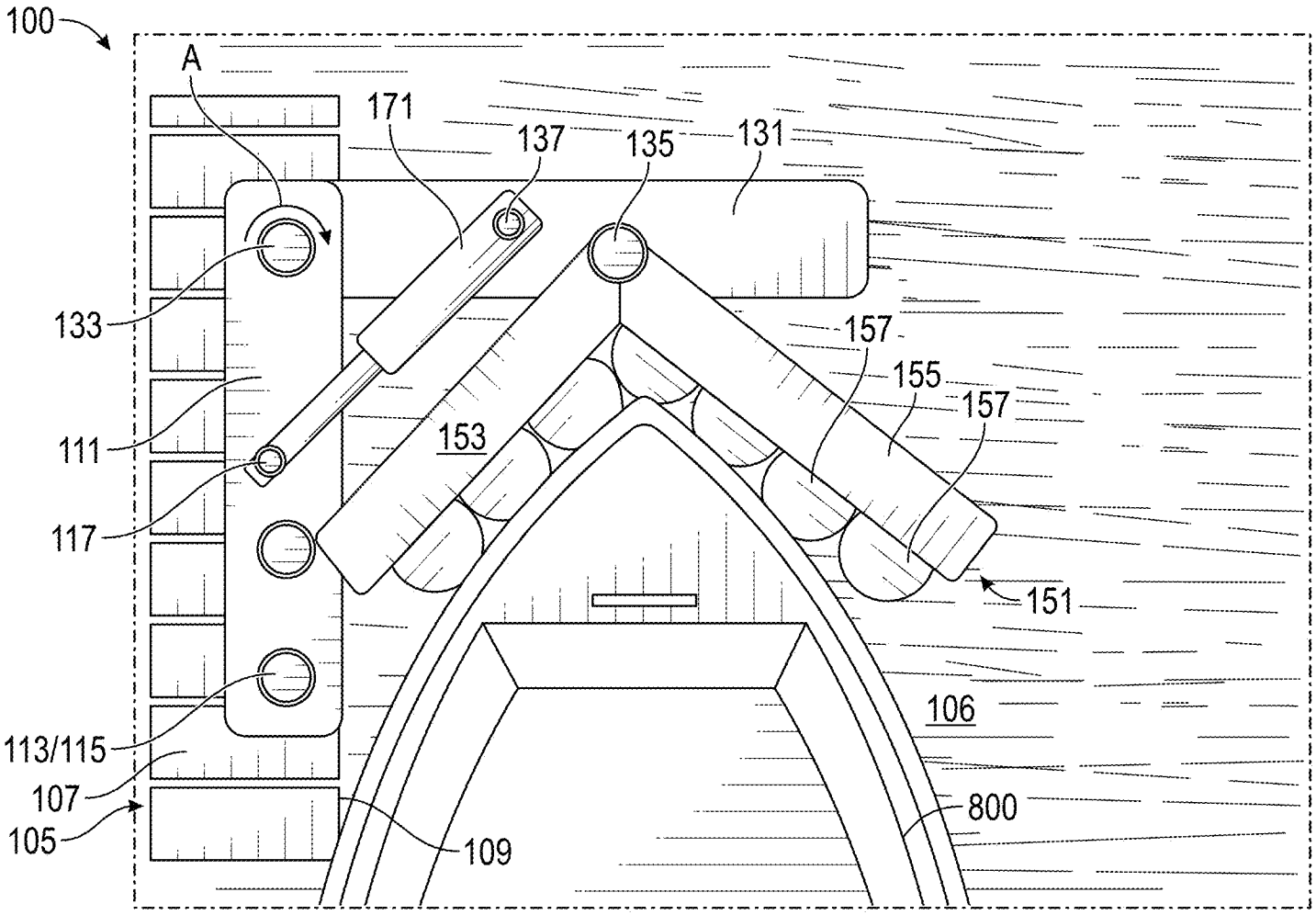
FIG. 1B is a diagram illustrating a boat's bow engaged with an embodiment of a docking assist assembly.
Figure 1C:
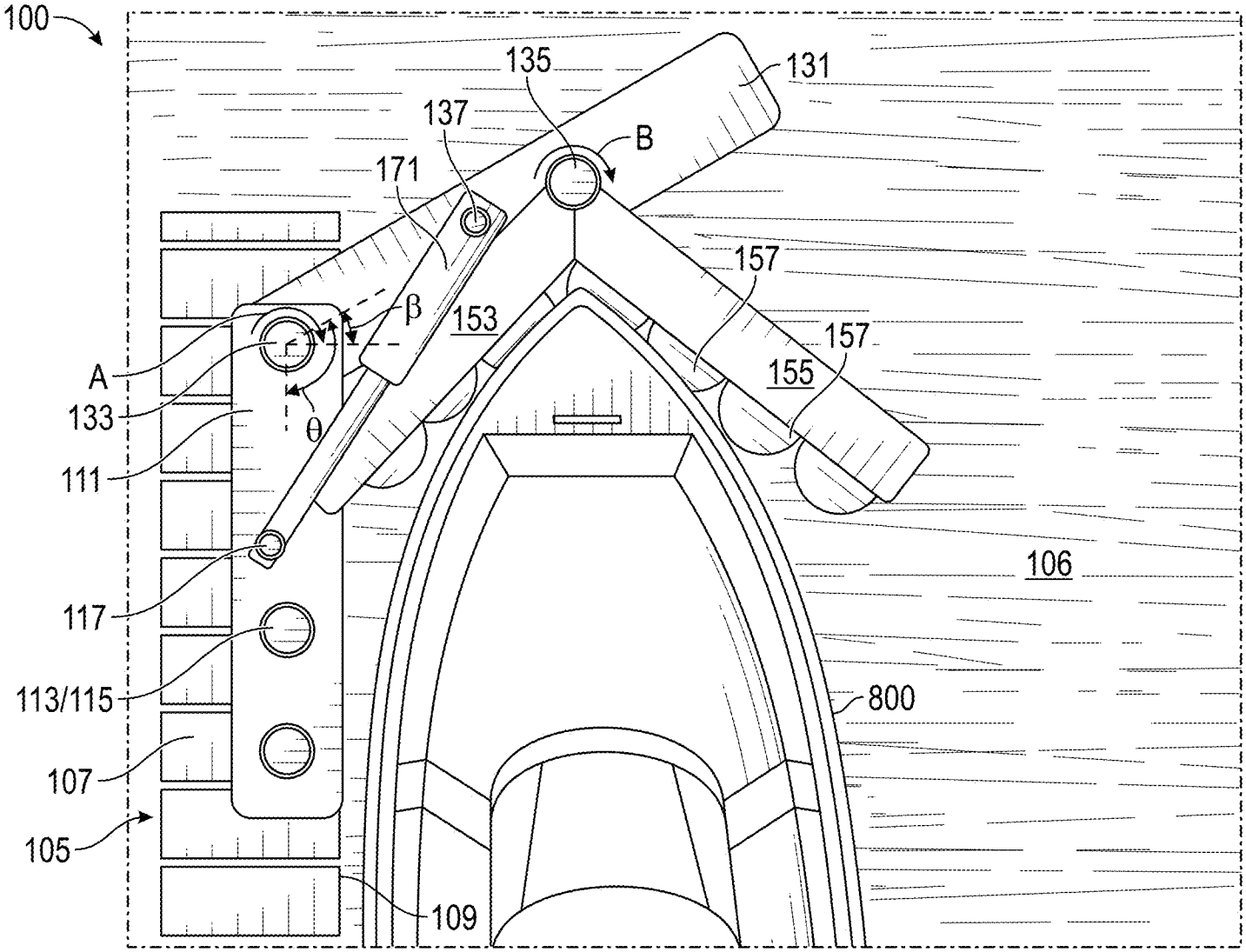
FIG. 1C is a diagram illustrating an embodiment of a docking assist assembly at maximum deflection.

Referring to FIG. 1A, in use, the dock mounting portion 111 of the docking assist assembly 100 may be fixed to a dock 105 which is positioned over and/or adjacent to a body of water 106 such that the docking portion 111 is near an elongate dock edge 109 that is adjacent to a pre-determined boat parking area of the body of water. The dock mounting portion 111 may run parallel to the edge 109 of the dock 105. In one aspect, the arm portion 131 may extend roughly perpendicular to the dock mounting portion 111 such that the arm portion 131 and the bow retaining portion 151 are suspended above the water. Suspension of arm portion 131 and bow retaining portion 151 above the water, may provide advantages such as allowing people to swim near the dock 105 without interference. An additional advantage may be that the docking assist assembly 100 can be used on either straight or L-shaped docks because only the mounting portion 111 needs to be fixed to the dock. First bow arm section 153 and second bow arm section 155 create a triangular shape or a V-shape that corresponds to the bow shape of a particular boat. The width of the bow retaining portion 151 measured by the tip of first bow arm section 153 from the tip of second bow arm section 155 is desirably somewhat larger than the front portion of a boat's bow, which may enable a boat to be guided into the docking assist assembly 100 by first bow arm section 153 and second bow arm section 155. In one aspect, when the first bow arm section 153 and second bow arm section 155 are moveable relative to each other, such that the docking assist assembly 100 may be used for many different types of watercraft with many different shaped bows. In this orientation, the bumper portion 157 on the first bow arm section 153 face the bumper portion 157 on second bow arm section 155. When a boat operator approaches the dock 105 to park the boat, the boat operator may drive the boat at a low speed or coast into the bow retaining portion 151 such that the bow of the boat engages the bumper portion 157 of the first bow arm section 153 on one side of the boat's bow (such as the port side of the bow) and the bow of the boat engages the bumper portion 157 of the second bow arm section 155 on the other side of the boat's bow (such as the starboard side of the bow), as shown in FIG. 1B. The bumper portion 157 absorb some of the incoming force of the boat and provide a soft impact area so as to not damage the bow of the boat. As the boat engages the bow retaining portion 151, a force is transmitted to the arm portion 131 causing rotation of the arm portion 131 about axis of rotation A. As the arm portion 131 rotates about axis of rotation A, the bow retaining portion 151 may rotate about axis of rotation B such that the boat 800 remains roughly perpendicular to the dock edge 109 as the arm portion 131 continues to rotate. Further rotation of arm portion 131 engages the shock absorption assembly 171 which limits further rotation of the arm portion 131 and absorbs the force of the incoming boat, stopping the boat. FIG. 1C illustrates an embodiment of the docking assist assembly 100 where the arm portion 131 is at a maximum rotational state after engaging the bow of a boat 800. It is recognized that the angle illustrated in FIG. 1C is for illustrative purposes only, and the maximum rotational state may vary depending on the embodiment implemented. The original or relaxed position of the arm portion 131 and the maximum position of rotation of the arm portion 131, define an angle β therebetween which faces the bow retaining portion 151. The dock edge 109 and the arm portion 131 define an angle θ which faces the bow retaining portion 151. In the illustrated embodiment, the angle θ is 90 degrees greater than the angle β. In some embodiments, the shock absorption assembly 171 prevents rotation of the arm portion 131 relative to its relaxed position by an angle β greater than 45 degrees, greater than 30 degrees, greater than 25 degrees, greater than 20 degrees, greater than 15 degrees or greater than 10 degrees. In some embodiments, the shock absorption assembly 171 prevents rotation of the arm portion 131 relative to the mounting portion 111 to an angle θ greater than 135 degrees, greater than 120 degrees, greater than 115 degrees, greater than 110 degrees, greater than 105 degrees or greater than 100 degrees. In some embodiments, the shock absorption assembly 171 permits rotation of the arm portion 131 relative to its relaxed position by an angle β of at least 10 degrees, at least 15 degrees, at least 20 degrees, at least 25 degrees, at least 30 degrees or at least 45 degrees. In some embodiments, the shock absorption assembly 171 permits rotation of the arm portion 131 relative to the mounting portion 111 to an angle θ of at least 100 degrees, at least 105 degrees, at least 110 degrees, at least 115 degrees, at least 120 degrees or at least 135 degrees. In some embodiments, the shock absorption assembly 171 permits rotation of the arm portion 131 relative to its relaxed position by angle θ between 10 and 45 degrees, between 10 and 30 degrees, between 10 and 25 degrees, between 10 and 20 degrees, between 10 and 15 degrees. In some embodiments, the shock absorption assembly 171 permits rotation of the arm portion 131 relative to the mounting portion 111 to an angle θ between 100 and 135 degrees, between 100 and 120 degrees, between 100 and 115 degrees, between 100 and 110 degrees, between 100 and 105 degrees. In some embodiments, the shock absorption assembly 171 permits rotation of the arm portion 131 relative to its relaxed position by angle θ between 15 and 45 degrees, between 15 and 30 degrees, between 15 and 25 degrees or between 15 and 20 degrees. In some embodiments, the shock absorption assembly 171 permits rotation of the arm portion 131 relative to the mounting portion 111 to an angle θ between 105 and 135 degrees, between 105 and 120 degrees, between 105 and 115 degrees or between 105 and 110 degrees. With a portion of the bow of the boat engaged within the bow retaining portion 151, the boat operator may then tie off the boat, such as tying the stern of the boat to the dock 105 by using a stern line.

In one aspect, the docking assist assembly 100 may be removable from the dock 105 once fixed, which may have the advantage of allowing the docking assist assembly 100 to be stored when not in use, such as, during the winter months in colder climates. To facilitate such removal, the docking assist assembly may desirably weigh less than 500 pounds, 400 pounds, 300 pounds, 200 pounds, 150 pounds, 125 pounds, 100 pounds, 75 pounds or 50 pounds.

Figure 2:
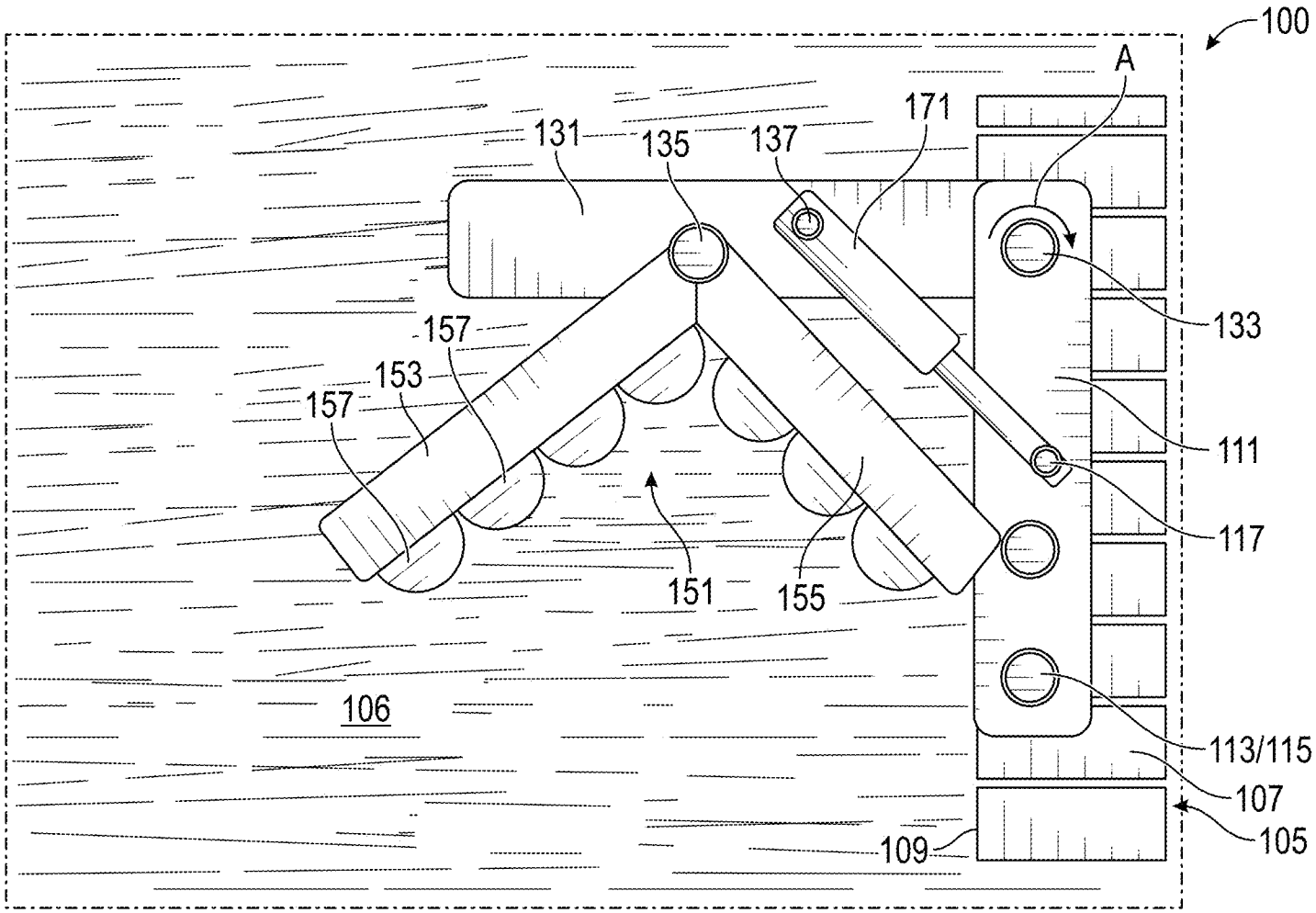
FIG. 2 is a diagram illustrating an embodiment of a docking assist assembly in a reversed orientation.

In one aspect, the docking assist assembly 100 may be reversible, as shown in FIG. 2, such that it may be used on either side of the dock 105. For example, when the docking assist assembly 100 is installed on one side of the dock 105, the right or starboard side of a boat would be closest to the dock 105, and when the docking assist assembly 100 is installed on the other side of the dock 105, as in FIG. 1A, the port side of a boat would be closets to the dock 105. The docking assist assembly 100 may be reversible by, for example, the mounting portion 111 being reversible such that the mounting portion 111 may be fixed to the dock 105 with either side facing the upper side 107 of the dock 105. In another aspect, the docking assist assembly 100 may be reversible by, for example, the bow retaining portion 151 being able to be fixed to the arm portion 131 with the bow retaining portion 151 facing either direction. Being reversible may have the advantage of allowing the docking assist assembly 100 to be used on any dock no matter which side of the dock is adjacent to the water 106. An additional advantage may be that two docking assist assemblies 100 could be used on the same dock to allow one or more boats to be parked on each side of the dock 105.

In one aspect, the mounting portion 111 may be a metal plate. In some aspects, the mounting portion 111 may be made of a galvanized, anodized, and/or the like material to prevent water damage. In some aspects, the dock fasteners 115 may be, for example, screws, bolts, and/or the like such that the docking assist assembly 100 may be removed and reinstalled to the dock 105 repeatedly.

In one aspect, the shock absorption assembly 171 may be a shock absorber, such as an air spring with a damper. Use of a shock absorber may provide the advantage of damping the return rotational force of the arm portion 131 after a boat has engaged the bow retaining portion 151. In some aspects, the shock absorption assembly 171 may be a pneumatic or hydraulic shock absorber.

In one aspect, the bumper portion 157 may be designed to partially deform under pressure, which may provide the advantage of cushioning the force applied to the bow of the boat. In some aspects, bumper portion 157 may comprise plastic foams made of polyethylene, polypropylene, polyurethane, and/or the like. In another aspect, bumper portion 157 may be made of rubber or any other material that can partially deform under the force of an incoming boat and prevent damage to the boat. In one aspect, docking assist assembly 100 may be waterproof or water resistant to prevent damage or decay of any components.

Figure 3:
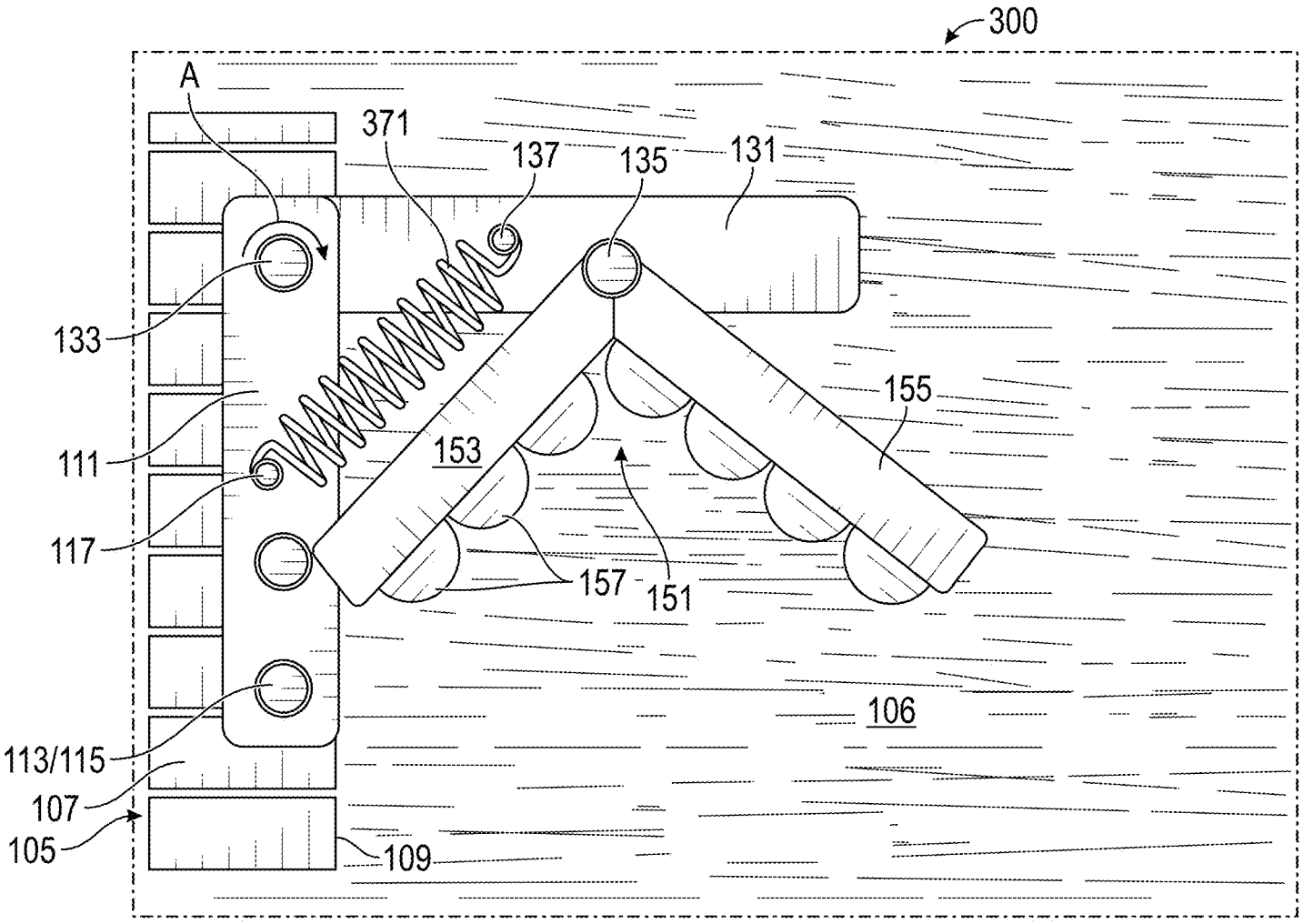
FIG. 3 is a diagram illustrating an embodiment of a docking assist assembly with a spring shock absorption assembly.

FIG. 3 illustrates another embodiment of a docking assist assembly 300 mounted on a dock 105. The docking assist assembly 300 includes a dock mounting portion 111, an arm portion 131, a bow retaining portion 151, and a shock absorption assembly 371. The docking assist assembly 300 contains the same elements and functions similarly to docking assist assembly 100, with the exception that the shock absorption assembly 371 comprises a spring.

Figure 4:
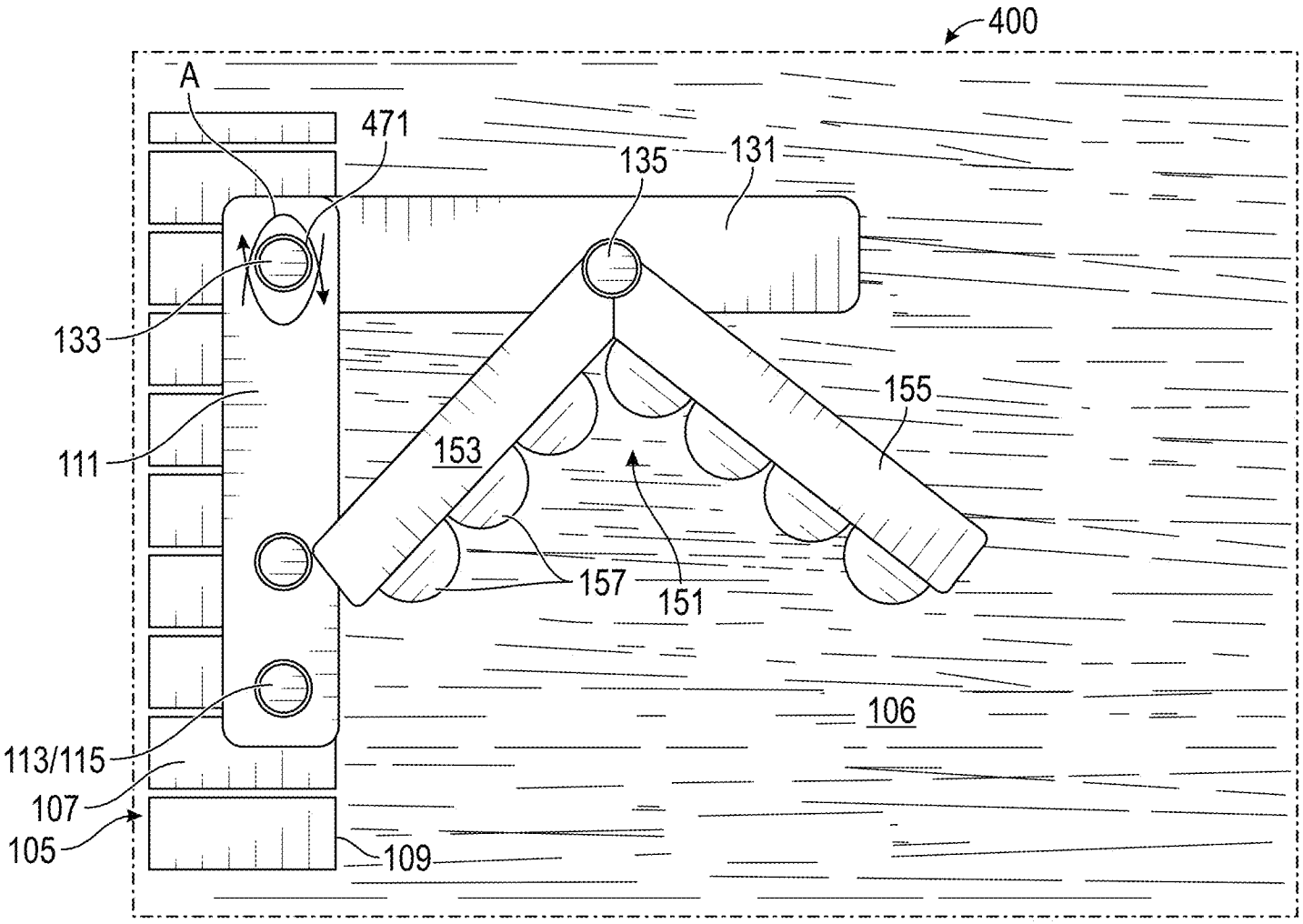
FIG. 4 is a diagram illustrating an embodiment of a docking assist assembly with a built-in vertical spring shock absorption assembly.

FIG. 4 illustrates another embodiment of a docking assist assembly 400 mounted on a dock 105. The docking assist assembly 400 includes a dock mounting portion 111, an arm portion 131, a bow retaining portion 151, and a shock absorption assembly 471. The docking assist assembly 400 contains most of the elements of and functions similarly to docking assist assembly 100, with the exception that the shock absorption assembly 471 comprises a spring assembly and/or damper assembly that may be built into the dock mounting portion 111 and coupled to arm portion 131 at one end such that rotation of the arm portion 131 about an axis of rotation A desirably causes the shock absorption assembly 471 to exert an opposing force movement from the relaxed position (e.g., as illustrated in FIG. 4) and a return force causing movement towards the relaxed position.

Referring to FIG. 4, in use, as the boat engages the bow retaining portion 151, a force is transmitted to the arm portion 131 causing rotation of the arm portion 131 about axis of rotation A. Rotation of arm portion 131 engages the shock absorption assembly 471 which limits further rotation of the arm portion 131 and absorbs the force of the incoming boat, stopping the boat.

Figure 5:
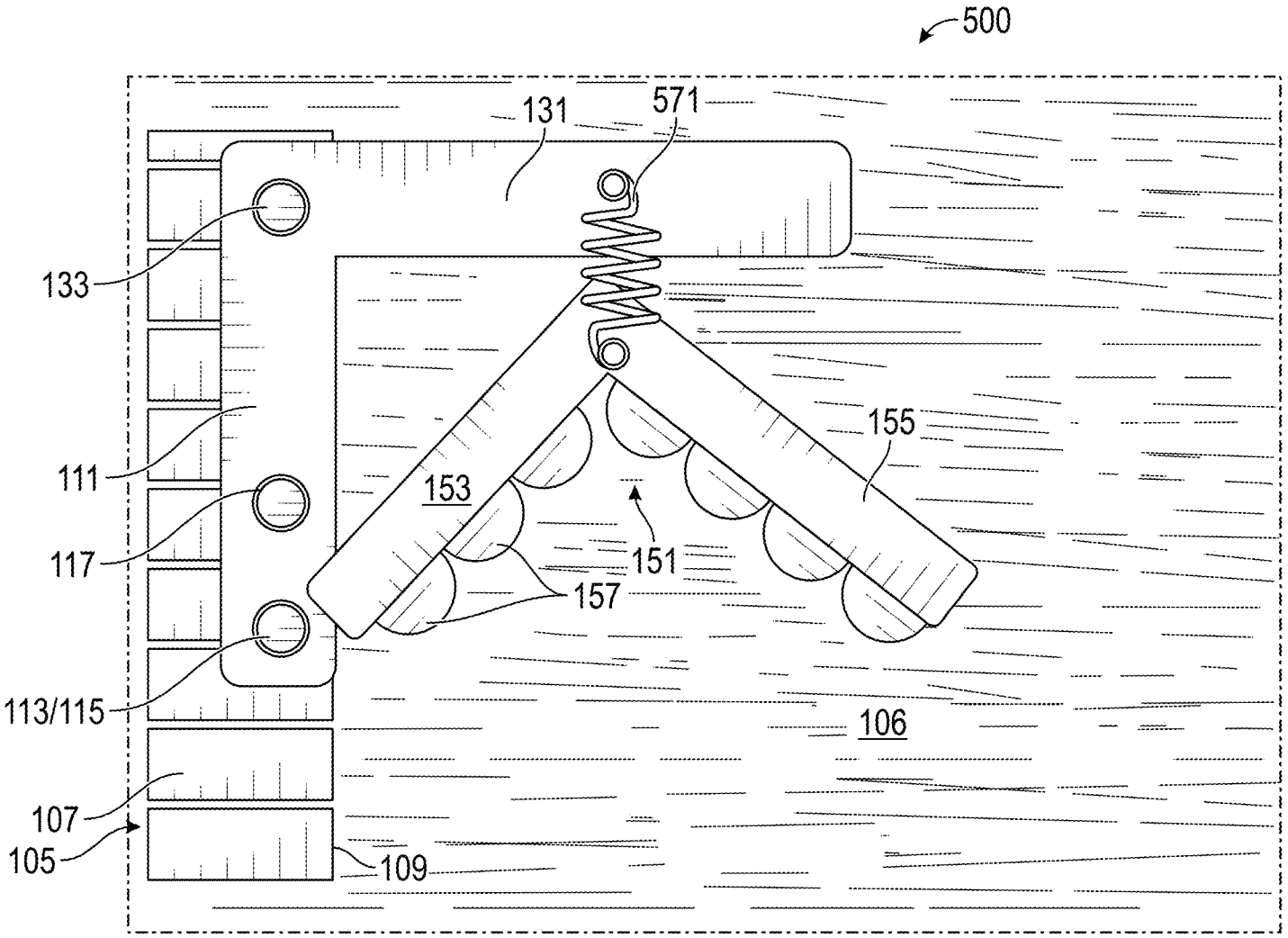
FIG. 5 is a diagram illustrating an embodiment of a docking assist assembly with a horizontal spring shock absorption assembly.

FIG. 5 illustrates an embodiment of a docking assist assembly 500 mounted on a dock 105. The docking assist assembly 500 includes a dock mounting portion 111, an arm portion 131, a bow retaining portion 151, and a shock absorption assembly 571. In one aspect, the arm portion 131 may include an arm mount 133 located at one end of the arm portion 131 to attach the arm portion 131 to the dock mounting portion 111 such that the arm portion 131 cannot rotate or rotates minimally relative to the arm mount 133. In this position, the arm portion 131 and the dock mounting portion 111 make a L-shape. In one aspect, the arm mount 133 may comprise a bolt extending through the arm portion 131 and into the dock mounting portion 111. In another aspect, the bolt may extend through the dock mounting portion 111 and into the dock 105. The bow retaining portion 151 may include a first bow arm section 153 and a second bow arm section 155. Either or both of the first bow arm section 153 and the second bow arm section 155 may include a resilient inner portion, such as a bumper portion 157. In one aspect, the first bow arm section 153 and the second bow arm section 155 may comprise a single integral piece. The shock absorption assembly 571 may comprise a spring and/or a damper. In one aspect, the shock absorption assembly 571 may include a damping assembly. The shock absorption assembly 571 is fixed at one end to the bow retaining portion 151 and fixed on another opposite end to the arm portion 131. In one aspect, the shock absorption assembly 571 may be fixed to the arm portion 131 and/or the bow retaining portion 151 by a bolt extending through the shock absorption assembly 571 and into the arm portion 131 and/or the bow retaining portion 151 at each end respectively. In another aspect, the shock absorption assembly 571 may be fixed to the arm portion 131 and/or the bow retaining portion 151 by welding. In one aspect, the first bow arm section 153 and the second bow arm section 155 may comprise a single integral piece. In another aspect, the shock absorption assembly 571 may be fixed to each the first bow arm section 153 the second bow arm section 155, such that both bow arm sections can rotate relative to the point of fixture, such as by a pivot assembly which, for example, comprises a shaft and a bearing. In another aspect, the shock absorption assembly 571 may further comprise a bow arm lock, such that rotation of first bow arm section 153 and second bow arm section 155 may be selectively prevented by engaging the bow arm lock. In another aspect, the first bow arm section 153 and the second bow arm section 155 are fixed with respect to one another. In another aspect, the first bow arm section 153 and the second bow arm section 155 define a V-shape with an angle $\alpha$ between them. Desirably the angle $\alpha$ is between 30 and 120 degrees, between 35 and 105 degrees and/or between 45 and 95 degrees. The bumper portion 157 may desirably be fixed to first bow arm section 153 and second bow arm section 155 on the inward facing side of each bow arm such that in operation, the bumper portion 157 on one arm face the bumper portion 157 on the other arm.

Referring to FIG. 5, in use, when a boat operator approaches the dock 105 to park the boat, the boat operator may drive the boat at a low speed or coast into the bow retaining portion 151 such that the bow of the boat engages the bumper portion 157 of the first bow arm section 153 on one side of the boat's bow (such as the port side of the bow) and the bow of the boat engages the bumper portion 157 of the second bow arm section 155 on the other side of the boat's bow (such as the starboard side of the bow). The bumper portion 157 absorb some of the incoming force of the boat and provide a soft impact area so at to not damage to the bow of the boat. As the boat engages the bow retaining portion 151, the bow retaining portion 151 moves towards the arm portion 131 and a force is transmitted to the shock absorption assembly 571, such that the spring is compressed as the boat continues to move the bow retaining portion 151. As the spring in the shock absorption assembly 571 is further compressed, the force of the incoming boat is translated to the shock absorption assembly 571, stopping the boat. With a portion of the bow of the boat engaged within the bow retaining portion 151, the boat operator may then tie off the boat, such as tying the stern of the boat to the dock 105 by using a stern line.

Figure 6:
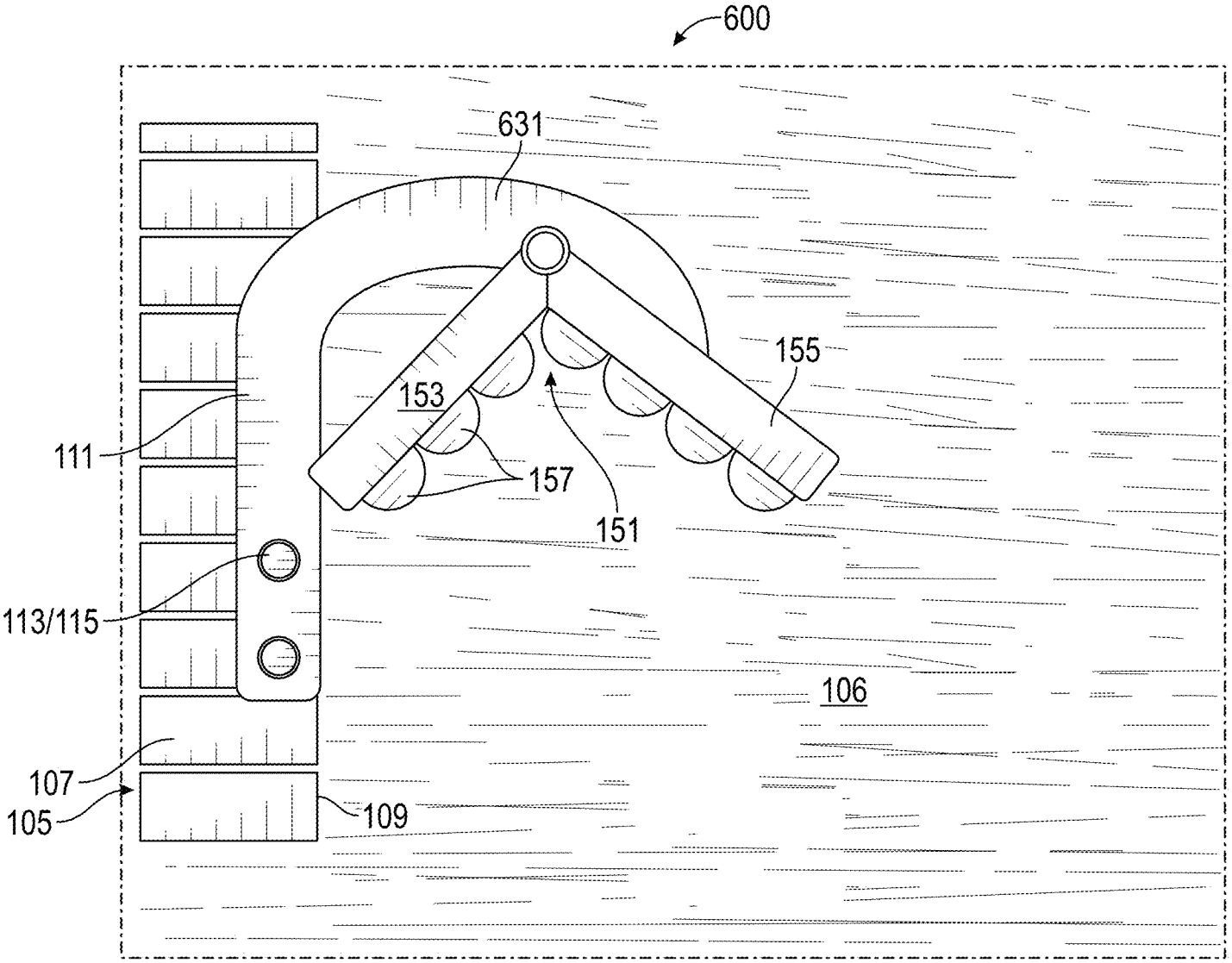
FIG. 6 is a diagram illustrating an embodiment of a docking assist assembly with a flexible arm portion.

FIG. 6 illustrates an embodiment of a docking assist assembly 600 mounted on a dock 105. The docking assist assembly 100 includes a dock mounting portion 111, an arm portion 631, and a bow retaining portion 151. The arm portion 631 is made of a resilient material such that the shape deforms in a non-plastic manner under an application of force. The arm portion 631 is connected to the dock mounting portion 111 at one end of the dock mounting portion 111. As illustrated, the arm portion 631 and the dock mounting portion 111 cooperate to make a J-shape. In one aspect, the arm portion 631 and the dock mounting portion 111 comprise two pieces, wherein the arm portion 631 may be removably fixed to the dock mounting portion 111 such as by a bolt extending through one end of the arm portion 631 and into the dock mounting portion 111. In another aspect the bolt extends into the dock 105. In another aspect, the arm portion 631 may be permanently fixed to the dock mounting portion 111, such as by welding. In another aspect, the dock mounting portion 111 and the arm portion 631 may form one integral piece. The first bow arm section 153 may be fixed at one end to the arm portion 631 and the second bow arm section 155 may be fixed at one end to the arm portion 631 such that both points of fixture are adjacent to each other on arm portion 631131. In one aspect, the first bow arm section 153 and the second bow arm portion 155 may be fixed to the arm portion 631 by a bolt which extends through the bow arm portions 153 and 155 and into the arm portion 631 to secure the bow arm portions 153 and 155 to the arm portion 631. In another aspect, the first bow arm section 153 and the second bow arm section 155 are rotationally moveable relative to their points of fixtures on the arm portion 631 such as by a pivot assembly which, for example, comprises a shaft and a bearing. In another aspect, the arm portion 631 may further comprise a bow arm lock, such that rotation of first bow arm section 153 and second bow arm section 155 may be selectively prevented by engaging the bow arm lock. For example, when the bow arm lock is engaged, the first bow arm section 153 and second bow arm section 155 cannot move relative to their point of fixture on the arm portion 631. In another aspect, the first bow arm section 153 and the second bow arm section 155 are fixed with respect to one another. In another aspect, the first bow arm section 153 and the second bow arm section 155 define a V-shape with an angle $\alpha$ between them. Desirably the angle $\alpha$ is between 30 and 120 degrees, between 35 and 105 degrees and/or between 45 and 95 degrees.

Referring to FIG. 6, in use, the dock mounting portion 111 of the docking assist assembly 100 may be fixed to a dock 105 which is positioned over and/or adjacent to a body of water 106 such that the docking portion 111 is near an elongate dock edge 109 that is adjacent to a pre-determined boat parking area of the body of water. The dock mounting portion 111 runs parallel to the edge 109 of the dock 105. In one aspect, the arm portion 631 may extend transverse, such as roughly perpendicular to the dock mounting portion 111 such that the arm portion 631 and the bow retaining portion 151 are suspended above the water. First bow arm section 153 and second bow arm section 155 create a triangular shape or a V-shape that corresponds to the bow shape of a particular boat. In this orientation, the bumper portion 157 on the first bow arm section 153 face the bumper portion 157 on second bow arm section 155. When a boat operator approaches the dock 105 to park the boat, the boat operator may drive the boat at a low speed or coast into the bow retaining portion 151 such that the bow of the boat engages the bumper portion 157 of the first bow arm section 153 on one side of the boat's bow (such as the port side of the bow) and the bow of the boat engages the bumper portion 157 of the second bow arm section 155 on the other side of the boat's bow (such as the starboard side of the bow). The bumper portion 157 absorb some of the incoming force of the boat and provide a soft impact area so at to not damage to the bow of the boat. As the boat engages the bow retaining portion 151, a force is transmitted to the arm portion 631, causing the arm portion 631 to flex, bend, deform, and/or the like. As the boat continues to apply a force to the arm portion 631, the force causes elastic deformation of the arm portion 631 which absorbs the force of the incoming boat, stopping the boat. With a portion of the bow of the boat engaged within the bow retaining portion 151, the boat operator may then tie off the boat, such as tying the stern of the boat to the dock 105 by using a stern line.

Figure 7:
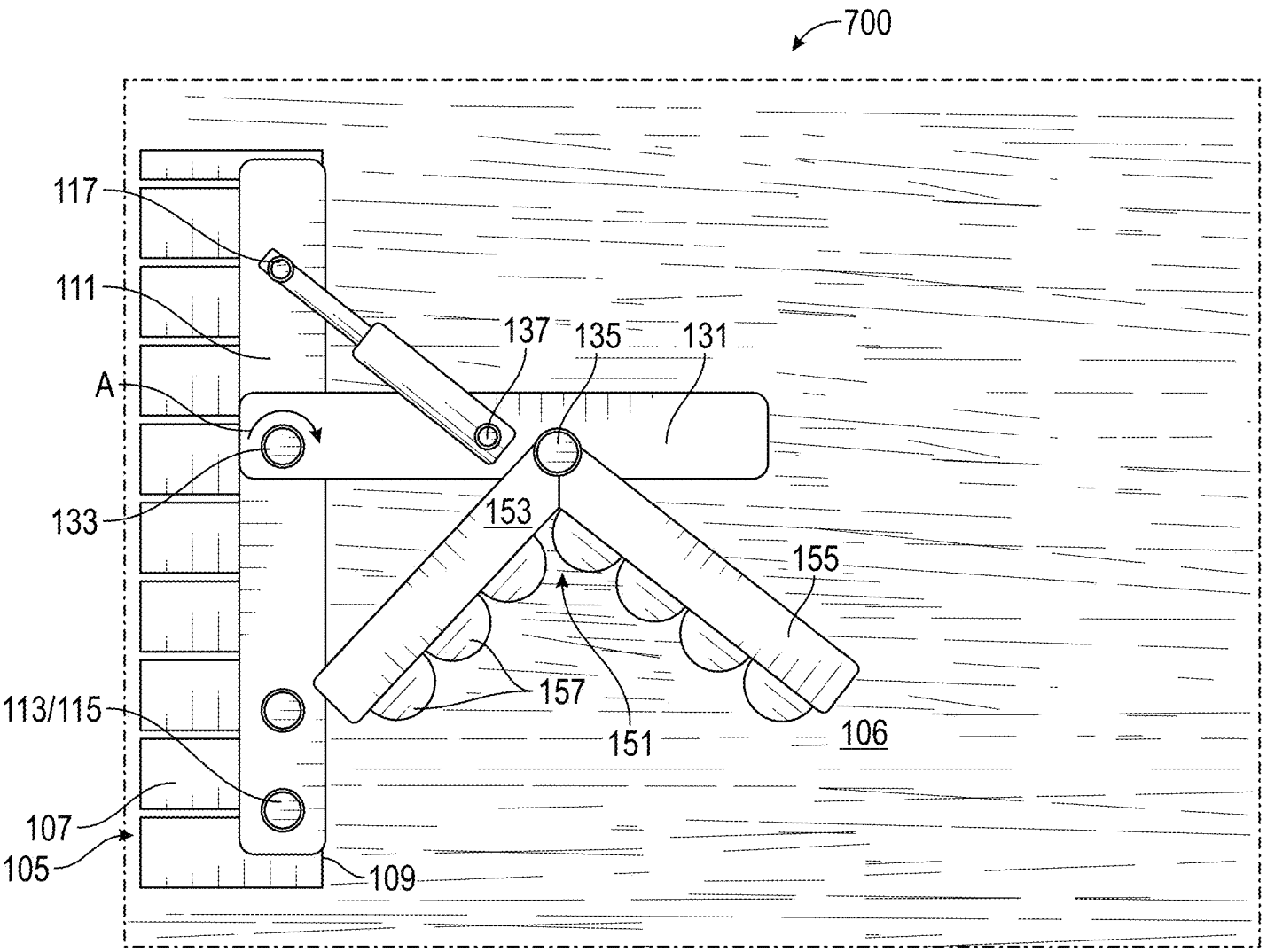
FIG. 7 is a diagram illustrating an embodiment of a T-shaped docking assist assembly.

FIG. 7 illustrates an embodiment of a docking assist assembly 700 mounted on a dock 105. In this embodiment, the docking assist assembly 700 is a T-shaped design. The docking assist assembly 700 includes a dock mounting portion 111, an arm portion 131, a bow retaining portion 151, and a shock absorption assembly 171. The docking assist assembly 700 contains the same elements and functions similarly to docking assist assembly 100, with the exceptions that the dock mounting portion 111 may extend further up the dock 105 such that a portion of the dock mounting portion 111 is above the arm portion 131. In one aspect, the dock mounting portion 111 may include additional mount holes 113 and dock fasteners 115. In one aspect, the absorber dock mount 117 is located further up the dock mounting portion 111. In this position, when a boat engages the dock bow retaining portion 151, the shock absorption assembly 171 compresses to absorb the force of the boat rather than extending in tension as in docking assist assembly 100.

Figure 8:
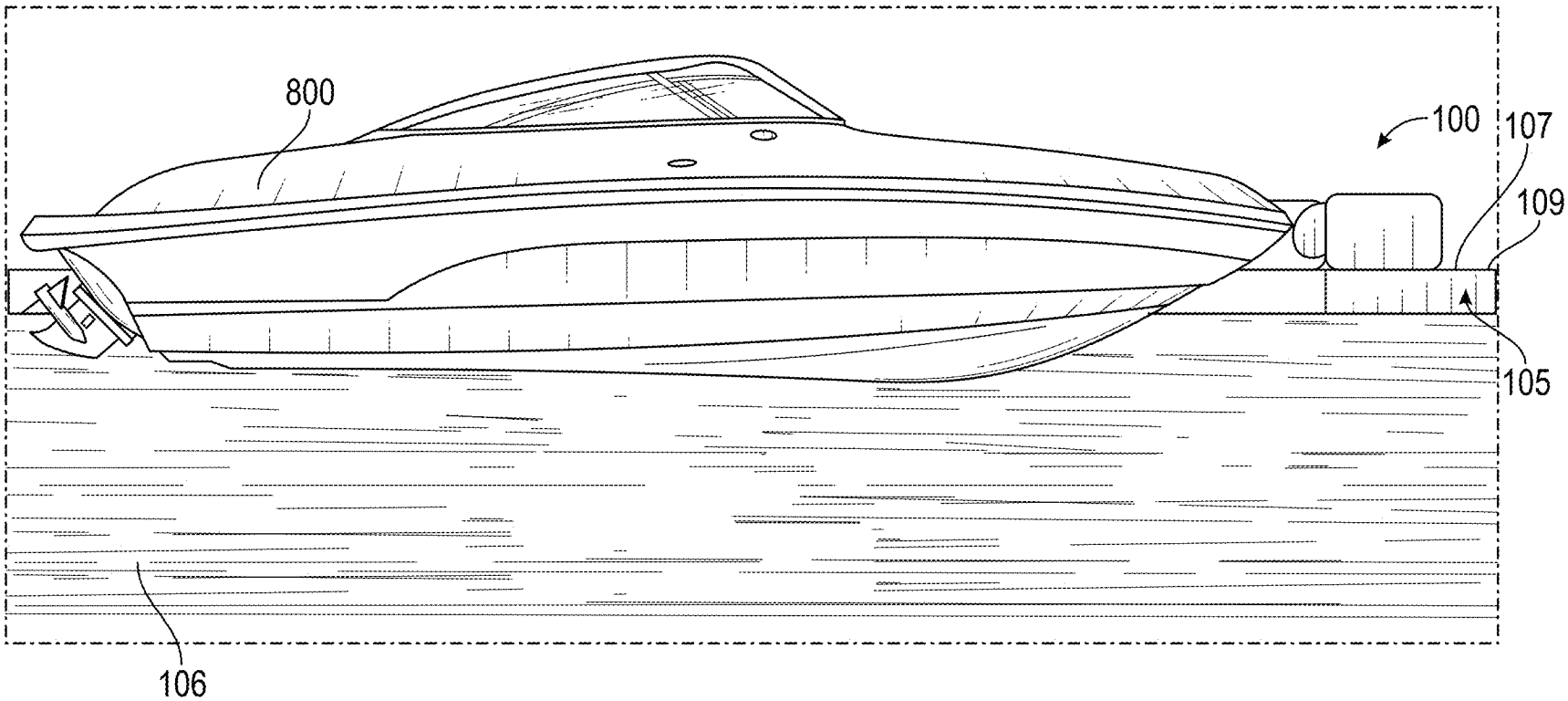
FIG. 8 is a diagram illustrating an embodiment of a docking assist assembly for a floating docking system.

FIG. 8 illustrates an embodiment of a boat 800 parked in a docking assist assembly 100 mounted to a dock 105. It is recognized that while the docking assist assembly 100 is illustrated in FIG. 8, any embodiment of a docking assist assembly described herein could be used. FIG. 8 shows an embodiment of a docking assist assembly 100 that can be used in a floating dock. In a floating dock, as the height of the water changes, the height of the dock 105 changes proportionally, such that the boat 800 can be parking in the docking assist assembly 100 at all water levels.

Figure 9:
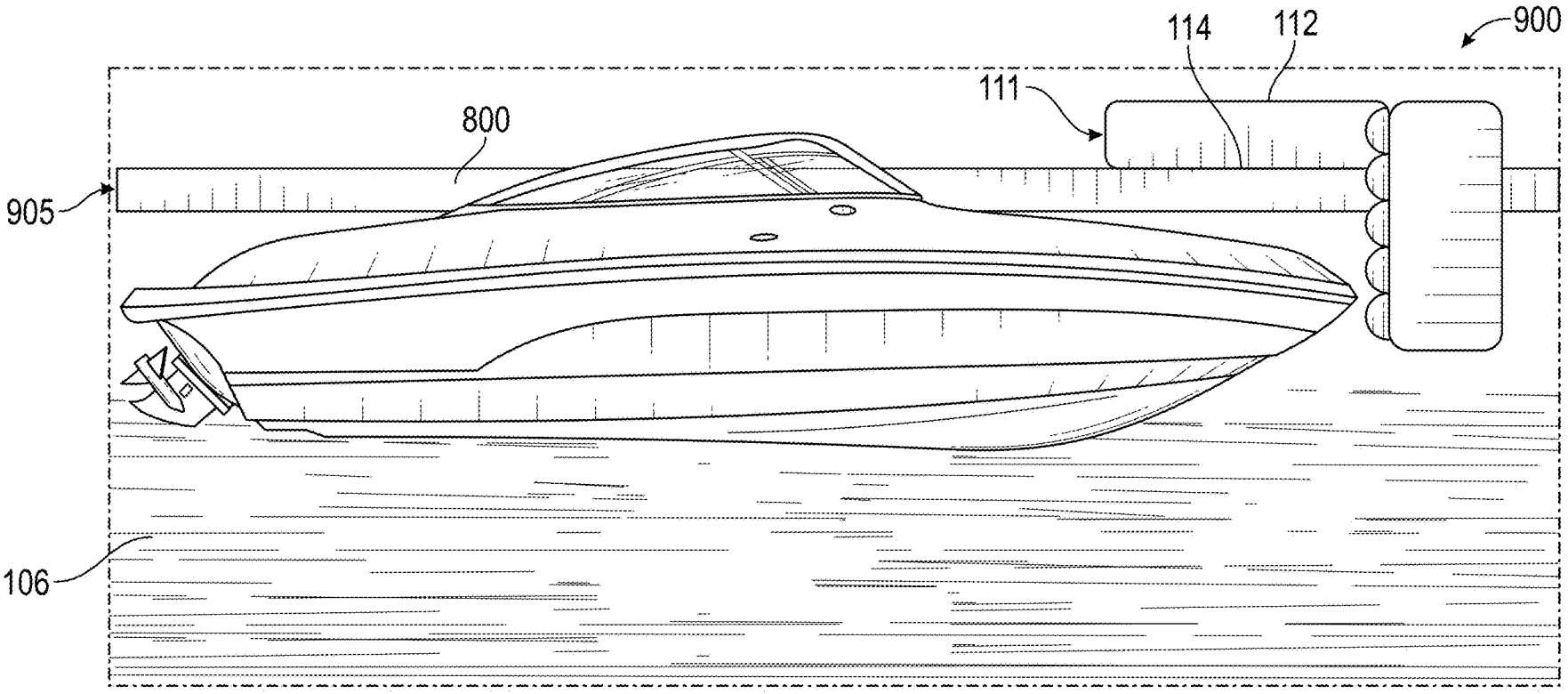
FIG. 9 is a diagram illustrating an embodiment of a docking assist assembly for a grounded docking system.

FIG. 9 illustrates an embodiment of docking assist assembly 900 which may be used for grounded or non-floating dock 905. When a dock is not floating, fluctuating water levels may impact the usability of the dock. As the water level drops, the height of a boat's bow relative to the dock decreases. Docking assist assembly 900 may be any embodiment of a docking assist assembly described herein, however, to accommodate for dropping water levels, the bow retaining portion 151 may extend further down towards the water. For example, the first bow arm section 153 and second bow arm section 155 may extend further down in a vertical direction towards the water. In one aspect, the bow retaining portion 151 may include more bumper portions 157 to cover the front of the first bow arm section 153 and the second bow arm section 155. In one aspect, the bow arms 153 and 155 of docking assist assembly 900 extend no more than two feet below the mounting portion in a direction towards the water.

In use, with a high water level, when a boat operator approaches the dock to park the boat 800, the boat operator may drive the boat 800 at a low speed or coast into the bow retaining portion 151 such that the bow of the boat 800 engages the bumper portion 157 near the top of the first bow arm section 153 on one side of the boat 800's bow (such as the port side of the bow) and the bow of the boat 800 engages the bumper portion 157 near the top of the second bow arm section 155 on the other side of the boat 800's bow (such as the starboard side of the bow). As the water level drops, when a boat operator parks the boat 800, the bow of the boat 800 will engage the bumper portions 157 on each bow arm section 153 and 155 at a lower height. The extended bow arm sections 153 and 155 may have the advantage of allowing boats to be parked at fluctuating water levels.

Figure 10:
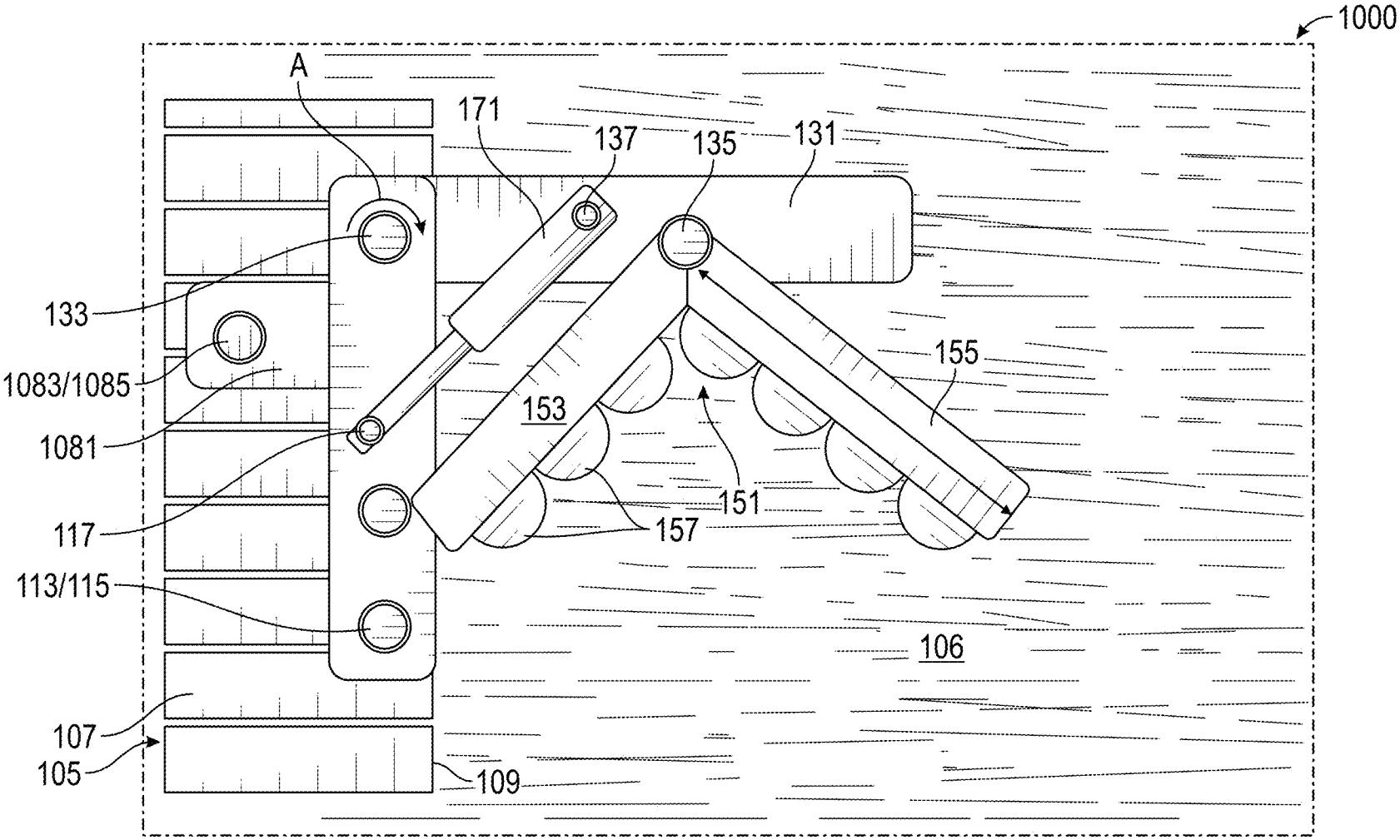
FIG. 10 is a diagram illustrating an embodiment of a docking assist assembly with a support plate.

FIG. 10 illustrates an embodiment of a docking assist assembly 1000 mounted on a dock 105. The docking assist assembly 100 includes a dock mounting portion 111, an arm portion 131, a bow retaining portion 151, a shock absorption assembly 171, and a fastener plate 1081. The fastener plate 1081 may comprise an elongate rectangular plate defining a planar surface which is positioned against the upper surface 107 of the dock 105. The fastener plate 1081 may include one or more mount holes 1083 extending through the fastener plate 1081 and one or more of dock fasteners 1085 extending through the fastener plate 1081 and into the dock 105 to secure the fastener plate 1081 in place. The fastener plate 1081 may be fixed to the dock mounting portion 111. In one aspect, the fastener plate 1081 may be fixed to the dock mounting portion 111 by one or more bolts which extend through opening(s) at one end of the fastener plate 1081 and into opening(s) in the dock mounting portion 111 which permits the fastener plate 1081 to be secured to the dock mounting portion 111. In another aspect, the bolt(s) may extend through the dock mounting portion 111 and into the dock 105. In another aspect the fastener plate 1081 may be welded to the dock mounting portion 111. In another aspect the fastener plate 1081 and the dock mounting portion 111 may form one integral part. The fastener plate 1081 may provide the advantage of offsetting some of the force on mounting portion 111, such as, for example, additional force provided from the increase in weight of bow arm sections 153 and 155 in the docking assist assembly 900 described in FIG. 9. It is recognized that while the docking assist assembly 1000 is illustrated in FIG. 10 to include fastener plate 1081, any embodiment of a docking assist assembly described herein can include fastener plate 1081.

Figure 11A:
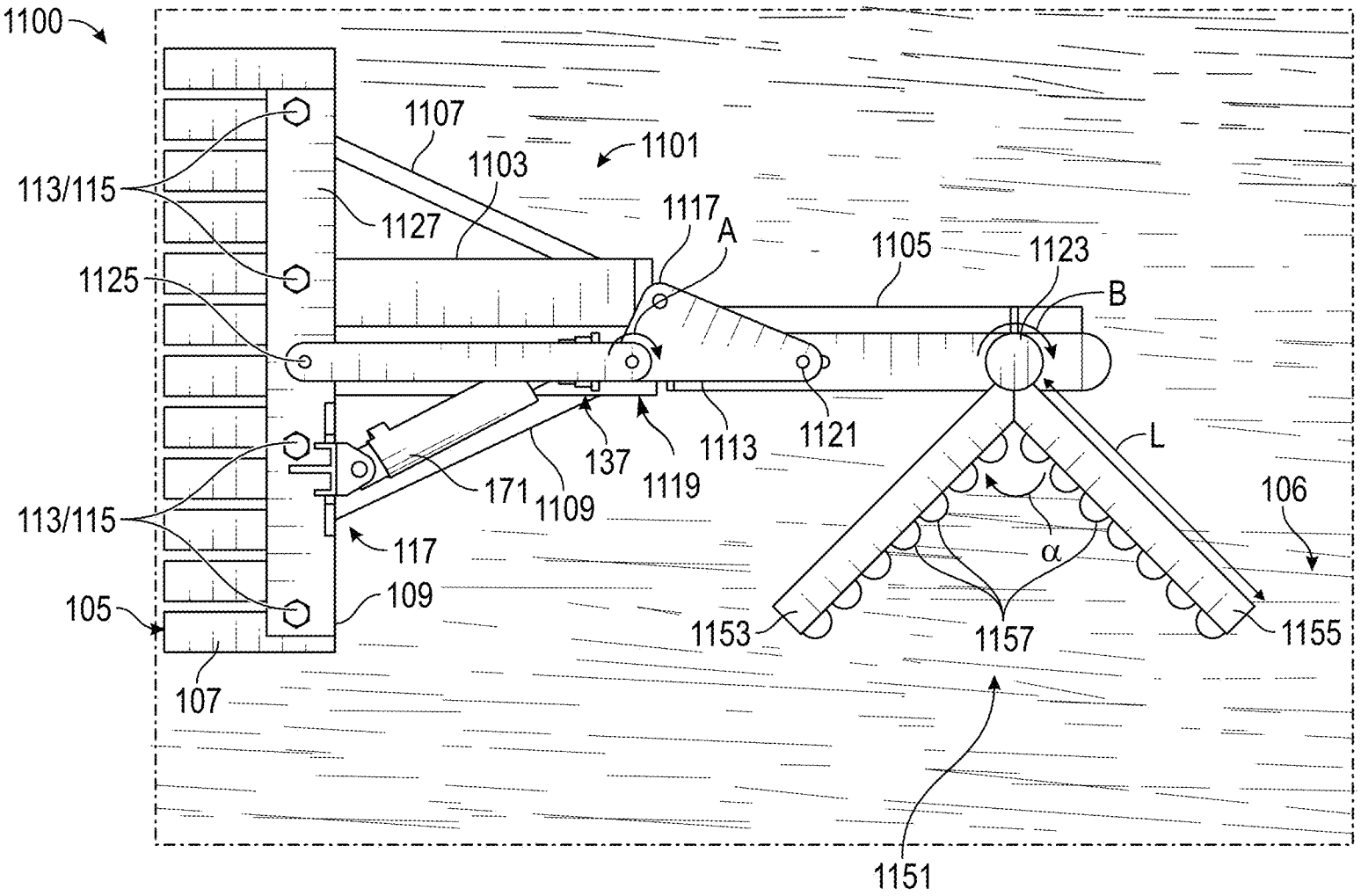
FIG. 11A is a diagram illustrating a top view of an embodiment of a docking assist assembly.
Figure 11B:
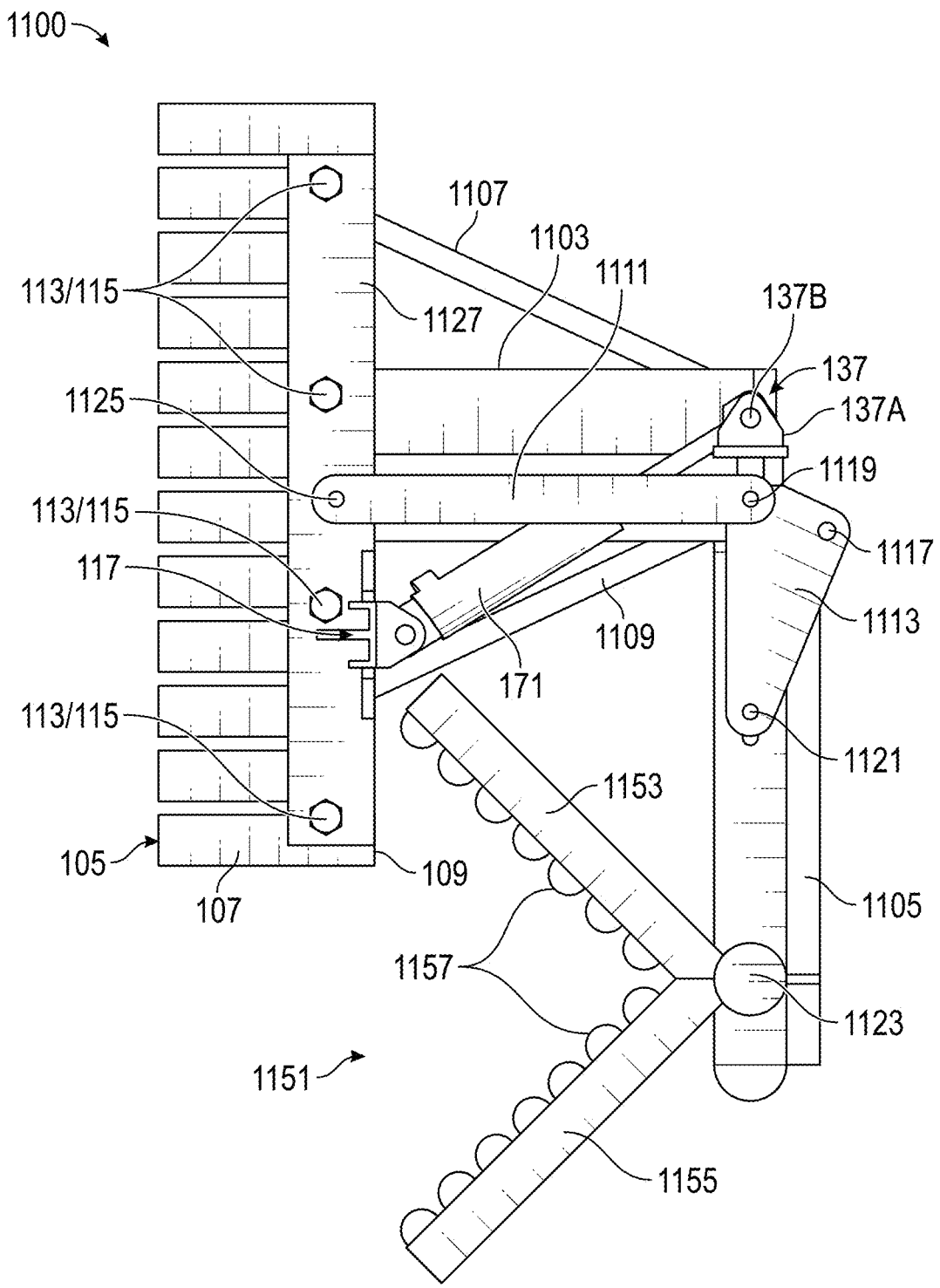
FIG. 11B is a diagram illustrating a top view of an embodiment of a rotated docking assist assembly.
Figure 11C:
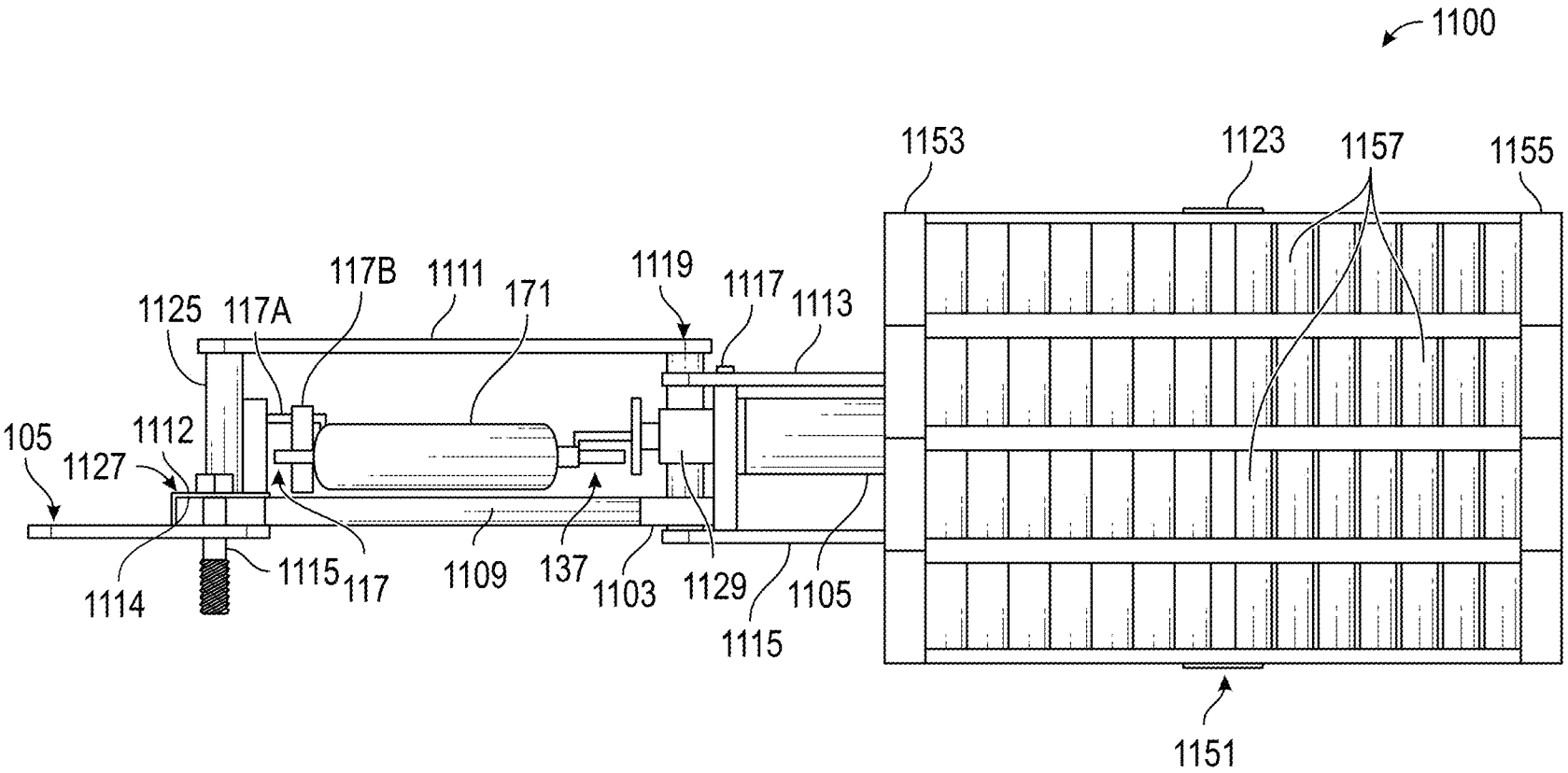
FIG. 11C is a diagram illustrating a front view of an embodiment of a docking assist assembly.
Figure 11D:
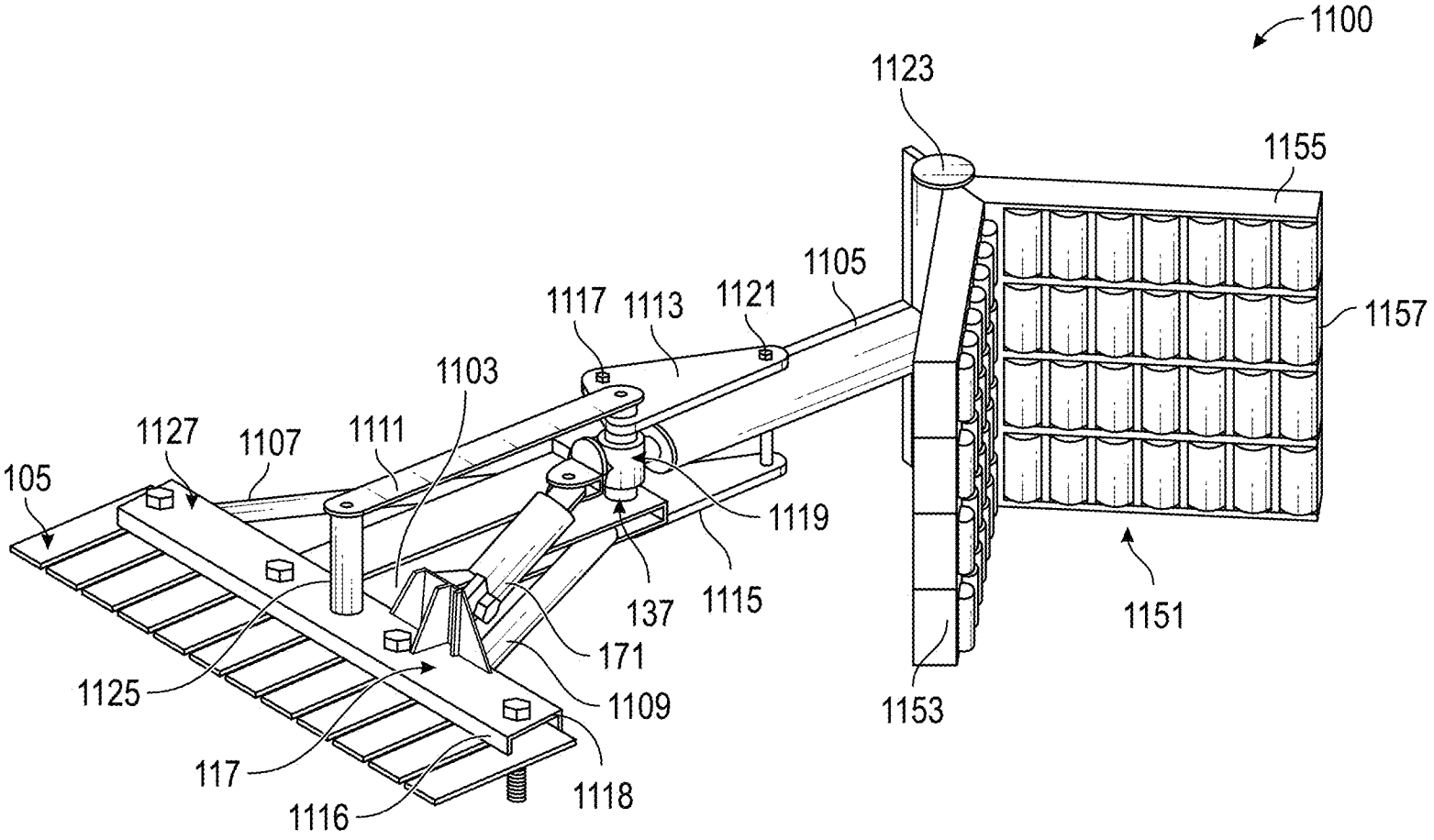
FIG. 11D is a diagram illustrating a first perspective view of an embodiment of a docking assist assembly.
Figure 11E:
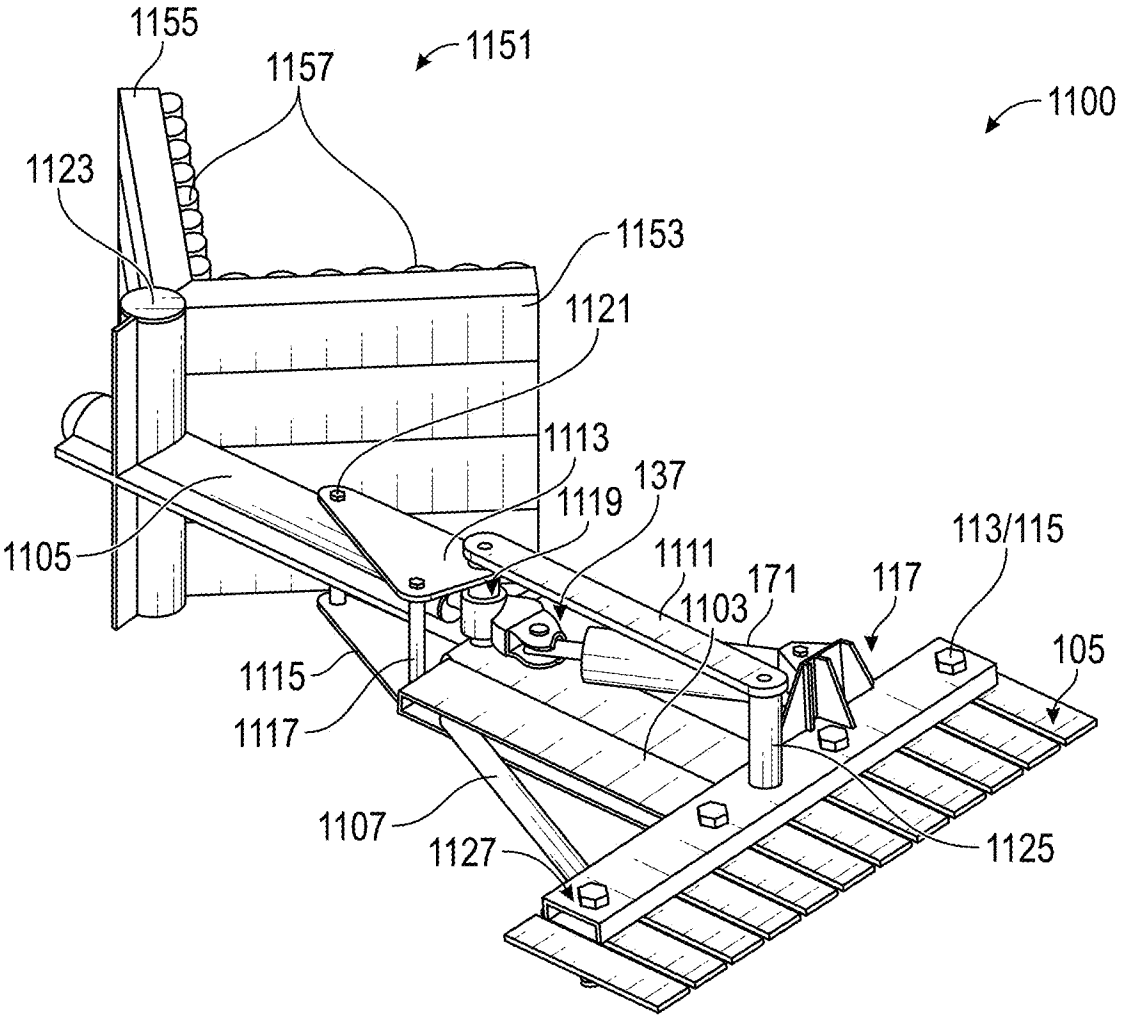
FIG. 11E is a diagram illustrating a second perspective view of an embodiment of a docking assist assembly.

FIGS. 11A-11E illustrate an embodiment of a docking assist assembly 1100 mounted on a dock 105. FIG. 11A illustrates a top view, FIG. 11B illustrates a top view in a rotated position, FIG. 11C illustrates a front view, and FIGS. 11D and 11E illustrate perspective views of the docking assist assembly 1100. The docking assist assembly 1100 includes a dock mounting portion 1127, an arm assembly 1101, a bow retaining portion 1151, and a shock absorption assembly 171. As discussed above, in some embodiments, there is no separate shock absorption assembly 171, but rather one or a combination of elements of the docking assist assembly 1100 permit the bow retaining portion 1151 and/or all or a portion of the arm assembly 1101 to move relative to the dock mounting portion 1127. The dock mounting portion 1127 may comprise an elongate rectangular plate defining a plane with an upper side 1112 and a bottom side 1114 (e.g., see FIG. 11C), and two approximately vertical sides 1116 and 1118 extending from the bottom side 1114 towards the dock 105, such that the two sides 1116 and 1118 contact the dock in an approximately perpendicular manner. The dock mounting portion 1127 is configured to be supported by the upper surface 107 of the dock 105. In one aspect, the dock mounting portion 1127 may comprise a bottom plate similar to the top rectangular plate such that the dock mounting portion 1127 comprises a hollow plank. The dock mounting portion 1127 may include mount holes 113 extending through the dock mounting portion 1127 and a plurality of dock fasteners 115 extending through the dock mounting portion 1127 and into the dock 105 to secure the dock mounting portion 1127 in place. The absorber dock mount 117 is located on the dock mounting portion 1127 and is used to secure one end of the shock absorption assembly 171 to the dock mounting portion 1127. The absorber dock mount 117 may comprise an assembly including a bracket 117A and a first absorber rod 117B (e.g., see FIG. 11C). The bracket 117A may be coupled to the dock mounting portion 1127 (e.g., by welding) and the first absorber rod 117B may extend through the bracket 117A and one end of the shock absorption assembly 171 to connect the shock absorption assembly 171 to the dock mounting portion 1127. The arrangement of the bracket 117A and first absorber rod 117B may allow the shock absorption assembly 171 to rotate about an axis defined by the first absorber rod 117B.

The arm assembly 1101 may include a first arm portion 1103 and a second arm portion 1105. The first arm portion 1103 may comprise a rectangular plate that is coupled to the dock mounting portion 1127 at one end and coupled to the second arm portion 1105 at the opposite end. For example, the first arm portion 1103 may be welded, bolted, screwed, and/or the like on one end to the dock mounting portion 1127. The first arm portion 1103 may be further supported by a first dock arm support 1107 on one side and a second dock arm support 1109 on the opposite side. The first dock arm support 1107 may be coupled at one end to dock mounting portion 1127 and coupled at the opposite end to the first arm portion 1103. Similarly, the second dock arm support 1109 may be coupled at one end to dock mounting portion 1127 and coupled at the opposite end to the first arm portion 1103, where the first dock arm support 1107 and the second dock arm support 1109 comprise an approximately triangular support structure for the arm assembly 1101. The second arm portion 1105 may comprise a cylindrical or tubular structure with a plate extending out of one side of the cylindrical portion. A first end of the second arm portion 1105 may comprise an arm connector 1129 that may be used to couple the second arm portion 1105 to a pivot assembly 1119. The arm connector 1129 may comprise a vertical hollow tube, configured to receive a rod. The second arm portion 1105 may be configured to rotate about an axis A defined by the pivot assembly 1119. Through the pivot assembly 1119, the second arm portion 1105 may be connected to the first arm portion 1103. The pivot assembly 1119 may comprise a vertical rod. The pivot assembly 1119 may be connected to the dock mounting portion 1127 by third dock arm support 1111. The third dock arm support 1111 may be coupled at one end to the top of the pivot assembly 1119 and coupled at the opposite end to first dock rod 1125. The top of the first dock rod 1125 may be coupled to the third dock arm support 1111 and the bottom of the first dock rod 1125 may be coupled to the dock mounting portion 1127. The first arm portion 1103 may be further coupled to the pivot assembly 1119 by a top arm plate 1113 and a bottom arm plate 1115. The top and bottom arm plates 1113 and 1115 may comprise triangular plates with rounded corners and may be coupled to various portions of the docking assist assembly 1100 at or near each corner. The top and bottom arm plates 1113 and 1115 may include a hole in a first corner that is configured to receive the pivot assembly 1119, such that the top and bottom arm plates 1113 and 1115 can rotate about an axis A defined by the pivot assembly 1119. The top arm plate 1113 may be coupled to the bottom arm plate 1115 by a first plate rod 1117 that may extend through the top arm plate 1113 and through the bottom arm plate 1115. The top and bottom arm plates 1113 and 1115 may be coupled to the second arm portion 1105 by a second plate rod 1121 that may extend through the top arm plate 1113, the second arm portion 1105, and the bottom arm plate 1115. In the aspect illustrated, the top arm plate 1113, the bottom arm plate 1115, and the second arm portion 1105 may be configured to rotate about an axis A defined by the pivot assembly 1119. The pivot assembly 1119 may be coupled to the shock absorption assembly 171 by absorber arm mount 137. The absorber arm mount 137 may comprise an assembly including a bracket 137A and a second absorber rod 137B (see FIG. 11B). The bracket 137A may be coupled to the arm connector 1129 (e.g., by welding) such that rotation of the second arm portion 1105 about the axis A causes equivalent rotation of the bracket 137A. The second absorber rod 137B may extend through the bracket 137A and one end of the shock absorption assembly 171 to connect the shock absorption assembly 171 to pivot assembly 1119 and the second arm portion 1105. The arrangement of the bracket 137A and second absorber rod 137B may allow the shock absorption assembly 171 to rotate about an axis defined by the second absorber rod 137B.

The second arm portion 1105 may be connected to the bow retaining portion 1151 by bow arm mount 1123. The bow arm mount 1123 may comprise a cylindrical or tubular structure with a plate extending out of one side of the cylindrical portion. The bow arm mount 1123 may extend through the second arm portion 1105 and may be approximately perpendicular to the second arm portion 1105. The bow retaining portion 1151 may include a first bow arm section 1153 and a second bow arm section 1155. Either or both of the first bow arm section 1153 and the second bow arm section 1155 may include a resilient inner portion, such as a bumper portion 1157. In one aspect, the first bow arm section 1153 and the second bow arm section 1155 may comprise a single integral piece. As illustrated in FIGS. 11C-11E, the bumper portion 1157 may comprises multiple rows and columns of smaller bumpers to optimize absorption and traction.

In docking assist assembly 1100, the dock mounting portion 1127 may be fixed to a dock 105 at mount holes 113 by dock fasteners 115 such that the sides of the dock mounting portion 1127 are approximately perpendicular to the upper surface of the dock. In the aspect illustrated, the second arm portion 1105 is mechanically coupled at one end to the first arm portion 1103 at pivot assembly 1119 such that the second arm portion 1105 is rotationally moveable relative to the first arm portion 1103. In one aspect, including the illustrated embodiment, the second arm portion 1105 may be rotationally movable relative to the first arm portion 1103 about axis of rotation A. In the position illustrated in FIG. 11A, the arm assembly 1101 and the dock mounting portion 1127 make a T-shape, which may be considered the relaxed position. In one aspect, the second arm portion 1105 may be configured to rotate in a first direction (e.g., counterclockwise in FIG. 11A) about the axis of rotation A relative to the first arm portion 1103. In some embodiments, the shock absorption assembly 171 prevents rotation of the second arm portion 1105 relative to the first arm portion 1103 in its relaxed position by an angle greater than 45 degrees, greater than 30 degrees, greater than 25 degrees, greater than 20 degrees, greater than 15 degrees or greater than 10 degrees in the first direction. In one aspect, the second arm portion 1105 may be rotationally movable relative to the first arm portion 1103 about axis of rotation A in a second direction, the second direction being opposite the first direction (e.g., clockwise in FIG. 11A). As shown in FIG. 11B, the second arm portion 1105 can rotate inwardly towards the dock 105 to minimize that amount of space the docking assist assembly 1100 occupies while not in use. In some embodiments, the docking assist assembly 1100 may prevents rotation of the second arm portion 1105 relative to the first arm portion 1103 in its relaxed position by an angle greater 90 degrees in the second direction. In one aspect, the pivot assembly 1119 may comprise any type of pivot assembly, such as shaft and a bearing assembly, to allow the second arm portion 1105 to rotate about axis of rotation A but limit the movement of the second arm portion 1105 in a direction extending vertically from the dock 105. As described above, the shock absorption assembly 171 is fixed at one end to the dock mounting portion 1127 at dock absorber mount 117 and fixed at another opposite end to the arm assembly 1101 at absorber arm mount 137. In one aspect, absorber dock mount 117 and/or absorber arm mount 137 may be a pivot assembly, such as a shaft (e.g., first absorber rod 117B and second absorber rod 137B) and bearing assembly, which may allow the shock absorption assembly 171 to rotate about its fixed points. The first bow arm section 1153 and the second bow arm section 1155 may be fixed at one end to the arm assembly 1101 at bow arm mount 1123. In the aspect illustrated, the first bow arm section 1153 and second bow arm section 1155 are fixed to the same bow arm mount 1123. In another aspect, there may be more than one bow arm mounts 1123, such that the first bow arm section 1153 and the second bow arm portion 1155 are fixed adjacent to each other on second arm portion 1105. In one aspect, the first bow arm section 1153 and the second bow arm section 1155 may be mechanically coupled at one end to the second arm portion 1105 at bow arm mount 1123 such that the bow retaining portion 1151 is rotationally moveable relative to the second arm portion 1105. In one aspect, the bow retaining portion 1151 may be rotationally movable relative to the second arm portion 1105 about axis of rotation B. In one aspect, the bow arm mount 1123 may comprise a pivot assembly, such as a shaft and a bearing assembly, to allow the bow retaining portion 1151 to rotate about axis of rotation B but limit the movement of the bow retaining portion 1151 in a direction extending vertically from the dock 105. In another aspect, the arm assembly 1101 may further comprise a bow arm lock, such that rotation of first bow arm section 1153 and second bow arm section 1155 may be selectively prevented by engaging the bow arm lock. For example, when the bow arm lock is engaged, the first bow arm section 1153 and second bow arm section 1155 cannot move relative to their point of fixture on the arm assembly 1101. In another aspect, the first bow arm section 1153 and the second bow arm section 1155 are fixed with respect to one another. In another aspect, the first bow arm section 1153 and the second bow arm section 1155 define a V-shape with an angle $\alpha$ between them which faces away from the second arm portion 1105. Desirably the angle $\alpha$ is between 30 and 120 degrees, between 35 and 105 degrees and/or between 45 and 95 degrees. The bumper portion 1157 may desirably be fixed to first bow arm section 1153 and second bow arm section 1155 on the inward facing side of each bow arm such that in operation, the bumper portion 1157 on one arm face the bumper portion 1157 on the other arm. In some embodiments, the resilient inner portion, such as a bumper portion 1157, may be integrally formed with the bow arm sections 1153 and 1155. The length "L" of the bow arm sections 1153 and 1155 is measured from the centerpoint of the bow arm mount 1123 to the tip of a bow arm section as shown on FIG. 11A. In one aspect, the first bow arm section 1153 and the second bow arm section 1155 are between 2 and 10 feet long, between 3 and 8 feet long or between 3 and 6 feet long. In one aspect, the first bow arm section 1153 and the second bow arm section 1155 are at least 2 feet long, at least 3 feet long, or at least 5 feet long. In one aspect, the first bow arm section 1153 and the second bow arm section 1155 are no more than 8 feet long, no more than 6 feet long, no more than 5 feet long or no more than 4 feet long. For purposes of this application, where the first arm section 1153 and the second arm section 1155 are a single integral piece, the length of the arm sections shall be considered the center-point 1123 of the contact between the bow arm section and the arm assembly 1101.

Referring to FIG. 11A, in use, the dock mounting portion 1127 of the docking assist assembly 1100 may be fixed to a dock 105 which is positioned over and/or adjacent to a body of water 106 such that the dock mounting portion 1127 is near an elongate dock edge 109 that is adjacent to a pre-determined boat parking area of the body of water. The dock mounting portion 1127 may run parallel to the edge 109 of the dock 105. In one aspect, the first arm portion 1103 may extend roughly perpendicular to the dock mounting portion 1127 such that the arm assembly 1101 and the bow retaining portion 1151 are suspended above the water. Suspension of arm assembly 1101 and bow retaining portion 1151 above the water, may provide advantages such as allowing people to swim near the dock 105 without interference. An additional advantage may be that the docking assist assembly 1100 can be used on either straight or L-shaped docks because only the dock mounting portion 1127 needs to be fixed to the dock. First bow arm section 1153 and second bow arm section 1155 create a triangular shape or a V-shape that corresponds to the bow shape of a particular boat. The width of the bow retaining portion 1151 measured by the tip of first bow arm section 1153 from the tip of second bow arm section 1155 is desirably somewhat larger than the front portion of a boat's bow, which may enable a boat to be guided into the docking assist assembly 1100 by first bow arm section 1153 and second bow arm section 1155. In one aspect, when the first bow arm section 1153 and second bow arm section 1155 are moveable relative to each other, such that the docking assist assembly 1100 may be used for many different types of watercraft with many different shaped bows. In this orientation, the bumper portion 1157 on the first bow arm section 1153 face the bumper portion 1157 on second bow arm section 1155. When a boat operator approaches the dock 105 to park the boat, the boat operator may drive the boat at a low speed or coast into the bow retaining portion 1151 such that the bow of the boat engages the bumper portion 1157 of the first bow arm section 1153 on one side of the boat's bow (such as the port side of the bow) and the bow of the boat engages the bumper portion 1157 of the second bow arm section 1155 on the other side of the boat's bow (such as the starboard side of the bow), as shown in FIG. 1B. The bumper portion 1157 absorb some of the incoming force of the boat and provide a soft impact area so as to not damage the bow of the boat. As the boat engages the bow retaining portion 1151, a force is transmitted to the second arm portion 1105 causing rotation of the second arm portion 1105 about axis of rotation A. As the second arm portion 1105 rotates about axis of rotation A, the bow retaining portion 1151 may rotate about axis of rotation B such that the boat 800 remains roughly perpendicular to the dock edge 109 as the second arm portion 1105 continues to rotate. Further rotation of the second arm portion 1105 engages the shock absorption assembly 171 which limits further rotation of the second arm portion 1105 and absorbs the force of the incoming boat, stopping the boat. With a portion of the bow of the boat engaged within the bow retaining portion 1151, the boat operator may then tie off the boat, such as tying the stern of the boat to the dock 105 by using a stern line.

In one aspect, the docking assist assembly 1100 may be removable from the dock 105 once fixed, which may have the advantage of allowing the docking assist assembly 1100 to be stored when not in use, such as, during the winter months in colder climates. To facilitate such removal, the docking assist assembly may desirably weigh less than 500 pounds, 400 pounds, 300 pounds, 200 pounds, 150 pounds, 125 pounds, 100 pounds, 75 pounds or 50 pounds. In one aspect, the first bow arm section 1153 and the second bow arm section 1155 and/or the bumper portion 1157 are resilient and are movable at least one inch in response to an impact force of 100 pounds.

In one aspect, the distance the docking assist assembly 1100 extends away from the elongate dock edge 109 of the dock 105 may be limited to prevent interference without other people and objects in the water. For example, in some embodiments, the length of extension of the arm assembly 1101 and the bow retaining portion 1151 away from the elongate dock edge 109 may be less than 10 feet, less than 8 feet, less than 6 feet, less than 4 feet, less than 2 feet, and/or the like.

Figure 13:
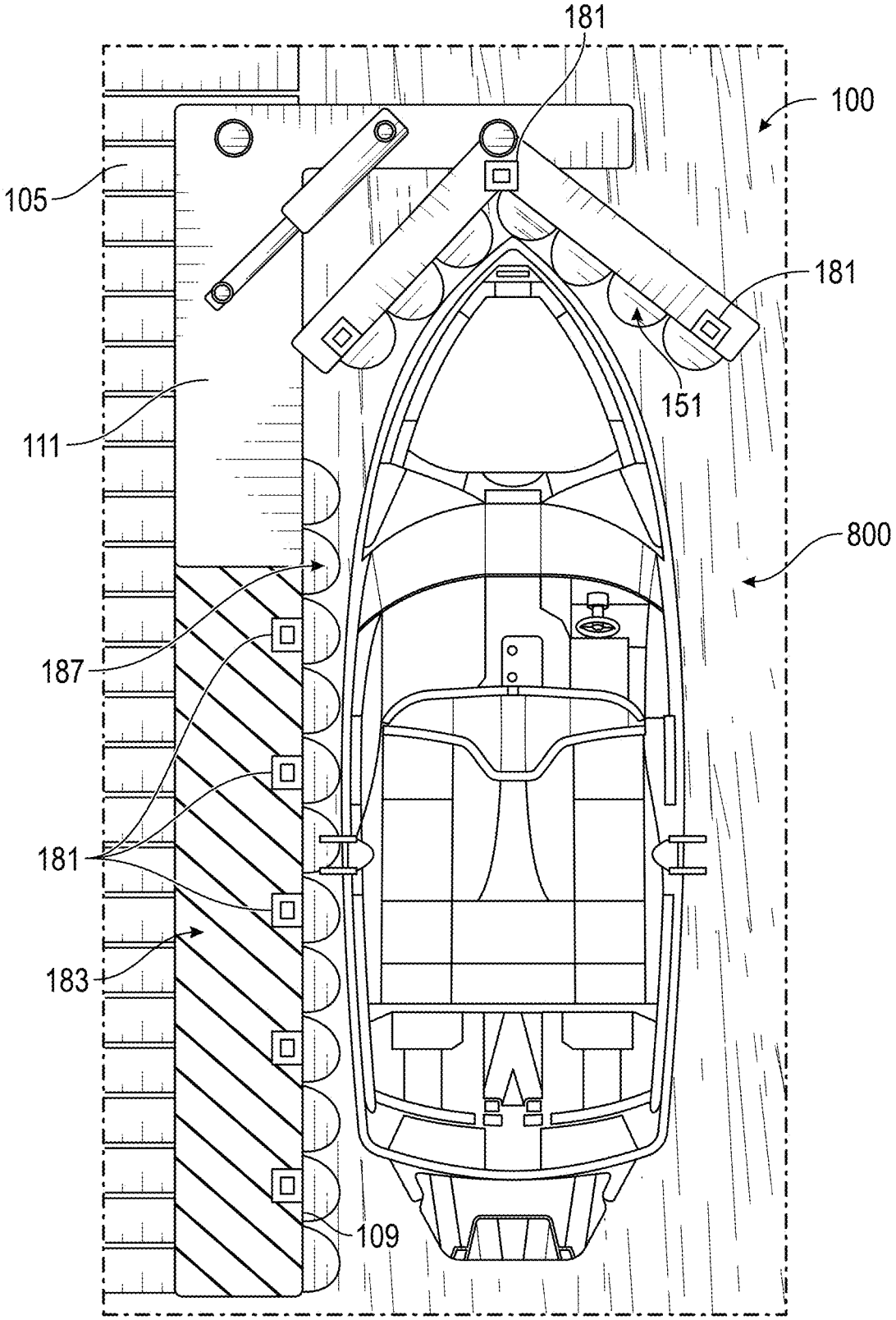
FIG. 13 is a diagram illustrating an embodiment of a docking assist assembly with additional safety components.

FIG. 13 illustrates an embodiment of a docking assist assembly 100 mounted on a dock 105 including additional safety components. While the docking assist assembly 100 is illustrated in FIG. 13, it is recognized that the safety components could be combined with any of the docking assist assemblies described herein (e.g., docking assist assembly 100, docking assist assembly 300, docking assist assembly 400, docking assist assembly 500, docking assist assembly 600, docking assist assembly 900, docking assist assembly 1000, docking assist assembly 1100, and/or the like).

In one aspect, the additional safety components may include lights 181, grip strip 183, and dock bumpers 187. The lights 181 may comprise any suitable light source, such as, for example, incandescent lights, fluorescent lamps, compact fluorescent lamps, halogen lamps, light emitting diodes, and/or the like. The number of lights 181 included in the system may vary depending on the strength of the lights and the size of the dock 105 and docking assist assembly 100. For example, the docking assist assembly 100 may include 1, 5, 10, 25, and/or the like lights 181. Generally, the lights 181 may be positioned anywhere on the docking assist assembly 100 and/or the dock 105. In one aspect, it may be preferable to include lights 181 on the bow retaining portion 151 (e.g., on a top, side, bottom, front, and/or the like surface of the bow retaining portion 151) to illuminate the docking area for the boat 800. For example, as shown in FIG. 13, lights 181 are positioned on a top surface of the bow retaining portion 151 to illuminate an area along the dock 105 where the boat is parked. When the lights 181 are arranged in this manner, the lights 181 may assist the boat operator in safely parking the boat 800. Lights 181 may also be positioned on the dock 105 and/or the grip strip 183. These lights 181 may be used to illuminate all or a portion of the dock 105 and/or further illuminate the boat parking area. Generally, the lights 181 may be configured to be waterproof to prevent damage while used with the docking assist assembly 100. In some embodiments, the lights 181 may be solar powered.

In one aspect, the grip strip 183 may be positioned on the dock 105 and may be adjacent to the docking assist assembly 100. For example, the grip strip 183 may be positioned along the elongate dock edge 109 of the dock 105. In one aspect, the grip strip 183 may be approximately the same height as the dock mounting portion 111 of the docking assist assembly 100. In some embodiments, the grip strip 183 may be configured to couple to the dock mounting portion 111. The grip strip 183 may comprise any suitable material for reducing the risk of a person on the dock 105 slipping. For example, the grip strip 183 may increase the traction between a person (e.g., a boat operator) and the dock 105. The grip strip 183 may be configured to removably or permanently couple to the dock 105. For example, the grip strip 183 may include an adhesive strip on one side that is configured to interface with an upper surface 107 of the dock 105. In one aspect, the grip strip 183 may comprise a material with sufficient roughness to reduce the chances of a person slipping. For example, the grip strip 183 may have minimum surface roughness (Rz) between 10 μm to 70 μm (e.g., between 10 μm to 70 μm, 20 μm to 60 μm, 30 μm to 50 μm, 35 μm to 45 μm, values between the foregoing, etc.). In some embodiments, it may be preferable for the grip strip 182 to have a minimum surface roughness of 20 μm or greater to reduce the risk of slipping when there is water on the grip strip 183. In some embodiments, the grip strip 183 may comprise a rubber material (e.g., vulcanized rubber), a plastic material (e.g., polyurethane), a vinyl material (e.g., polyvinyl chloride (PVC), and/or the like.

In one aspect, the docking assist assembly 100 may include dock bumpers 187. The dock bumpers 187 may extend along the elongate dock edge 109 of the dock 105. In one aspect, the dock bumpers 187 may be coupled to the docking assist assembly 100, such as, for example, to the dock mounting portion 111. The dock bumpers 187 may be similar or identical to the bumper portion 157 and are configured to allow the boat 800 to contact the dock bumpers 187 while reducing the risk of damage to the boat 800. For example, the dock bumpers 187 may be configured to resiliently deform upon contact from the boat 800. The dock bumpers 187 may extend from the side of the dock 105 in a direction towards the water. The height and length of the dock bumpers 187 may vary based on the size of the docking assist assembly 100 and the boat 800.

In some embodiments, some, or all of the components of the docking assist assembly 100 may be colored to match color of a user's boat 800. For example, a user may be able to customize the color of the docking assist assembly 100 to match the color of the boat 800.

Additional Embodiments

While certain embodiments of the inventions have been described, these embodiments have been presented by way of example only and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A docking assist assembly, comprising:

a mounting portion configured to be supported by an upper surface of a dock;

an arm supported by the mounting portion configured to extend transverse to an edge of the dock along which a length of a boat is intended to dock; and a bow retaining portion supported by the arm, the bow retaining portion including a first side and a second side, the first side defining a first surface facing at least partially toward the second side and the second side defining a second surface at least partially facing toward the first side, said first side and said second side configured to releasably engage and receive a bow of the boat at least partially between the first side and the second side during docking;

a shock absorption assembly comprising a shock absorber or a spring;

a pivot assembly connecting the mounting portion and the arm;

wherein the arm is movable relative to the mounting portion about the pivot assembly, the docking assist assembly having a relaxed position, the shock absorption assembly resisting movement of the arm relative to the mounting portion about the pivot assembly so as to at least partially absorb a docking impact force of the boat and applying force to move the arm towards the relaxed position about the pivot assembly after at least partially absorbing the docking impact force of the boat;

wherein said first side and said second side of the bow retaining portion are movable with respect to one another to facilitate receiving different shape bows there between.

2. The docking assist assembly of claim 1, wherein the first side and the second side of the bow retaining portion are no longer than 8 feet long.

3. The docking assist assembly of claim 1, wherein the first side and the second side of the bow retaining portion are no longer than 6 feet long.

4. The docking assist assembly of claim 1, wherein said first side and said second side of the bow retaining portion are resilient and are movable at least one inch in response to an impact force of 100 pounds.

5. The docking assist assembly of claim 1, wherein neither the arm, nor the bow retaining portion projects more than ten feet beyond the mounting portion.

6. The docking assist assembly of claim 1, wherein the docking assist assembly weighs no more than 500 pounds.

7. The docking assist assembly of claim 1, wherein the arm comprises a first arm portion and a second arm portion, wherein the second arm portion is rotatably connected to the first arm portion and a maximum amount of rotation of the second arm portion from the relaxed position is 45 degrees in a first direction.

8. The docking assist assembly of claim 7, wherein the second arm portion is rotatable relative to the first arm portion and the maximum amount of rotation of the second arm portion from the relaxed position is 90 degrees in a second direction.

9. The docking assist assembly of claim 1 further comprising one or more of: lights coupled to the bow retaining portion, a slip resistant platform configured to couple with the upper surface of the dock, and a resilient dock bumper portion configured to couple to a water facing side of the dock.

10. A docking assist assembly mountable to a dock having a support area and an elongate edge along which a boat is to be docked, the docking assist assembly comprising:

a mounting portion defining a support base;

an arm supported by the mounting portion configured to extend transverse to the edge of a dock along which a length of the boat is intended to dock, at least a portion of the arm movable with respect to the support base; and a bow retaining portion supported by the arm, the bow retaining portion including a first side and a second side, the first side defining a first surface facing at least partially toward the second side and the second side defining a second surface at least partially facing toward the first side, said first side and said second side configured to releasably engage and receive a bow of the boat at least partially between the first side and the second side during docking;

a shock absorption assembly comprising a shock absorber or a spring;

wherein the shock absorption assembly permits the arm to move relative the mounting portion parallel to the support base by at least 10 degrees from a relaxed position in response to a docking impact force of the boat;

wherein when the support base is facing downward both the arm and the bow retaining portion either (1) do not extend below the support base or (2) extend less than two feet below the support base;

wherein said first side and said second side at least partially include resilient areas configured to cushion the bow of the boat impacting the resilient areas.

11. The docking assist assembly of claim 10, wherein the bow retaining portion is resilient and is movable at least one inch in response to an impact force of 100 pounds.

12. The docking assist assembly of claim 10, wherein said first side and said second side are movable with respect to one another to facilitate receiving different shape bows there between.

13. The docking assist assembly of claim 10, wherein the docking assist assembly weighs no more than 500 pounds.

* * * * *